US006846132B2

(12) United States Patent
Kennedy et al.

(10) Patent No.: US 6,846,132 B2
(45) Date of Patent: Jan. 25, 2005

(54) MINE STOPPING AND BRACES THEREFOR

(75) Inventors: William R. Kennedy, Taylorville, IL (US); John M. Kennedy, Taylorville, IL (US)

(73) Assignee: Jack Kennedy Metal Products & Buildings, Inc., Taylorville, IL (US)

( * ) Notice: Subject to any disclaimer, the term of this patent is extended or adjusted under 35 U.S.C. 154(b) by 0 days.

(21) Appl. No.: 10/353,854

(22) Filed: Jan. 29, 2003

(65) Prior Publication Data

US 2003/0147706 A1 Aug. 7, 2003

Related U.S. Application Data

(60) Provisional application No. 60/353,243, filed on Feb. 1, 2002.

(51) Int. Cl.[7] ..... E21F 1/14

(52) U.S. Cl. ..... 405/132; 299/12; 454/169

(58) Field of Search ..... 405/132, 151, 405/152, 272, 274, 276, 288, 290, 294; 299/11, 12; 454/168, 169

(56) References Cited

U.S. PATENT DOCUMENTS

| | | | | |
|---|---|---|---|---|
| 251,698 A | | 1/1882 | Coats et al. | |
| 617,163 A | | 1/1899 | Jacobs | |
| 891,897 A | | 6/1908 | Astrom | |
| 1,478,303 A | | 12/1923 | Snyder | |
| 1,594,921 A | | 8/1926 | Barnett | |
| 2,350,113 A | | 5/1944 | Hurley | |
| 2,729,064 A | | 1/1956 | Kennedy et al. | |
| 3,186,177 A | | 6/1965 | Kannenberg | |
| 3,851,856 A | | 12/1974 | Berg | |
| 3,937,026 A | | 2/1976 | Krings | |
| 3,969,852 A | | 7/1976 | Krings | |
| 3,972,272 A | | 8/1976 | Bagby | |
| 4,054,033 A | | 10/1977 | Pillosio | |
| 4,345,857 A | | 8/1982 | Krings | |
| 4,397,224 A | * | 8/1983 | Walker | 454/169 |
| 4,483,642 A | | 11/1984 | Kennedy et al. | |
| 4,547,094 A | | 10/1985 | Kennedy et al. | |
| 4,685,837 A | | 8/1987 | Cicanese | |
| 4,695,035 A | * | 9/1987 | Kennedy et al. | 405/132 |
| RE32,675 E | | 5/1988 | Kennedy et al. | |
| RE32,871 E | | 2/1989 | Kennedy et al. | |
| 4,820,081 A | | 4/1989 | Kennedy et al. | |
| 4,911,577 A | | 3/1990 | Kennedy et al. | |
| 5,167,474 A | | 12/1992 | Kennedy et al. | |
| 5,215,411 A | | 6/1993 | Seegmiller | |
| 5,222,838 A | | 6/1993 | Kennedy et al. | |
| 5,813,647 A | | 9/1998 | Chen | |
| RE36,853 E | * | 9/2000 | Kennedy et al. | 405/132 |
| 6,220,785 B1 | * | 4/2001 | Kennedy et al. | 405/132 |
| 6,379,084 B1 | | 4/2002 | Kennedy et al. | |
| 6,457,906 B1 | * | 10/2002 | Kennedy et al. | 405/151 |
| 6,682,263 B2 | * | 1/2004 | Kennedy et al. | 405/132 |
| 2002/0098046 A1 | | 7/2002 | Kennedy et al. | |

FOREIGN PATENT DOCUMENTS

| | | |
|---|---|---|
| CA | 2328552 | 4/2002 |
| FR | 2610986 A1 | 9/1988 |

OTHER PUBLICATIONS

Kennedy Interlocking Overcasts brochure, Jack Kennedy Metal Products & Buildings, Inc., Nov. 6, 2000.
Kennedy Steel Stoppings brochure, Jack Kennedy Metal Products & Buildings, Inc., Aug. 9, 2002.

* cited by examiner

*Primary Examiner*—Frederick L. Lagman
(74) *Attorney, Agent, or Firm*—Senniger Powers

(57) ABSTRACT

A mine stopping installed in a mine passageway includes a plurality of elongate panels extending generally vertically in side-by-side relation from a floor to a roof of the passageway to at least partially close the passageway. A generally horizontal elongate brace extends generally between the walls of the passageway adjacent to the panels. A generally vertical column extends from the floor to the roof and is adapted for reinforcing the brace. Braces and anchor beams for stoppings are also disclosed.

36 Claims, 20 Drawing Sheets

MINE STOPPING AND BRACES THEREFOR

CROSS-REFERENCE TO RELATED APPLICATION

This application claims priority from U.S. Patent Application No. 60/353,243 (provisional), filed Feb. 1, 2002, which is hereby incorporated by reference.

BACKGROUND OF THE INVENTION

This invention relates to mine stoppings and to braces for such mine stoppings.

Mine stoppings are widely used in mine passageways to stop off the flow of air therethrough. A conventional metal stopping shown in U.S. Pat. No. 4,483,642 comprises a plurality of elongate extensible panels 7 extending vertically from the floor to the roof of the mine passageway and positioned in side-by-side relation across the passageway. (See FIG. 1 of the patent.)

Some mine passages can be quite large, e.g., 20 feet wide and 10 feet high and even as large as 60 feet wide and 35 feet high. Further, the pressure differential across a stopping can be very high. The high pressure differential and/or the large size of the mine passages that a stopping closes can subject the stopping to large forces which cause the stopping to bend or deflect. Satisfactory high pressure stoppings are disclosed in our co-pending U.S. patent application Ser. No. 10/061,146 filed Feb. 1, 2002, and in our U.S. Pat. No. 6,379,084, filed Dec. 17, 1999, both of which are incorporated herein by reference. This application is directed to improvements in stoppings and braces that are particularly advantageous for high pressure or large mine passageways.

SUMMARY OF THE INVENTION

Among the several objects of this invention may be noted the provision of an improved mine stopping and stopping braces capable of use in large or high pressure mine passageways; the provision of such stopping and braces that will be effective in at least partially stopping the flow of air through the mine passageway; the provision of such stopping and braces that are easy to install and maintain without excessive attention.

In one aspect, apparatus of this invention is a mine stopping installed in a mine passageway having a floor, a roof and opposing walls. The stopping comprises a plurality of elongate panels extending generally vertically in side-by-side relation from adjacent the floor to adjacent the roof of the passageway to at least partially close the passageway. An elongate brace extends generally horizontally between the side walls of the passageway adjacent to the panels. A generally vertical column extends from the floor to the roof and is adapted for reinforcing the brace.

In another aspect of the invention, the mine stopping comprises a stopping wall having a lower end adjacent the floor of the passageway and a generally horizontal anchor beam secured to the floor and positioned adjacent the lower end of the stopping wall for inhibiting movement of the panels under a transverse load applied to the stopping.

In yet another aspect of the present invention, the mine stopping comprises a stopping wall having an upper end adjacent the roof and a generally horizontal anchor beam secured to the roof and positioned adjacent the upper end of the stopping wall for inhibiting movement of the panels under a transverse load applied to the stopping.

In still another aspect, a brace of the invention is adapted for reinforcing a mine stopping system against deflection when the system is under load. The brace comprises a chord having opposite ends adapted to be secured to respective side walls of the passageway adjacent the stopping. At least one structural member has at least one end secured to the chord and adapted to extend generally outwardly away from the stopping when the brace is installed adjacent the stopping. A support is connected to the at least one structural member and has an end adapted to engage the floor or the roof of the mine passageway for supporting the brace.

In another aspect, a brace for extending between opposite side walls of the mine passageway comprises a central beam and at least one slide member connected to the central beam. The slide member is adapted for extensible movement relative to the central beam whereby the brace has a variable length. The central beam is I-beam shaped and the at least one slide member is channel shaped for mating engagement with the central beam.

Another brace of the invention comprises a central beam, at least one slide member slidably connected to the central beam to provide relative movement therebetween whereby the brace has a variable length. At least one securement member is fixed to the central beam and adapted for connection to the stopping wall. The securement member includes an extensible member slidably connected to the securement member to provide relative movement therebetween. A coupling connects the slide member and the extensible member.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
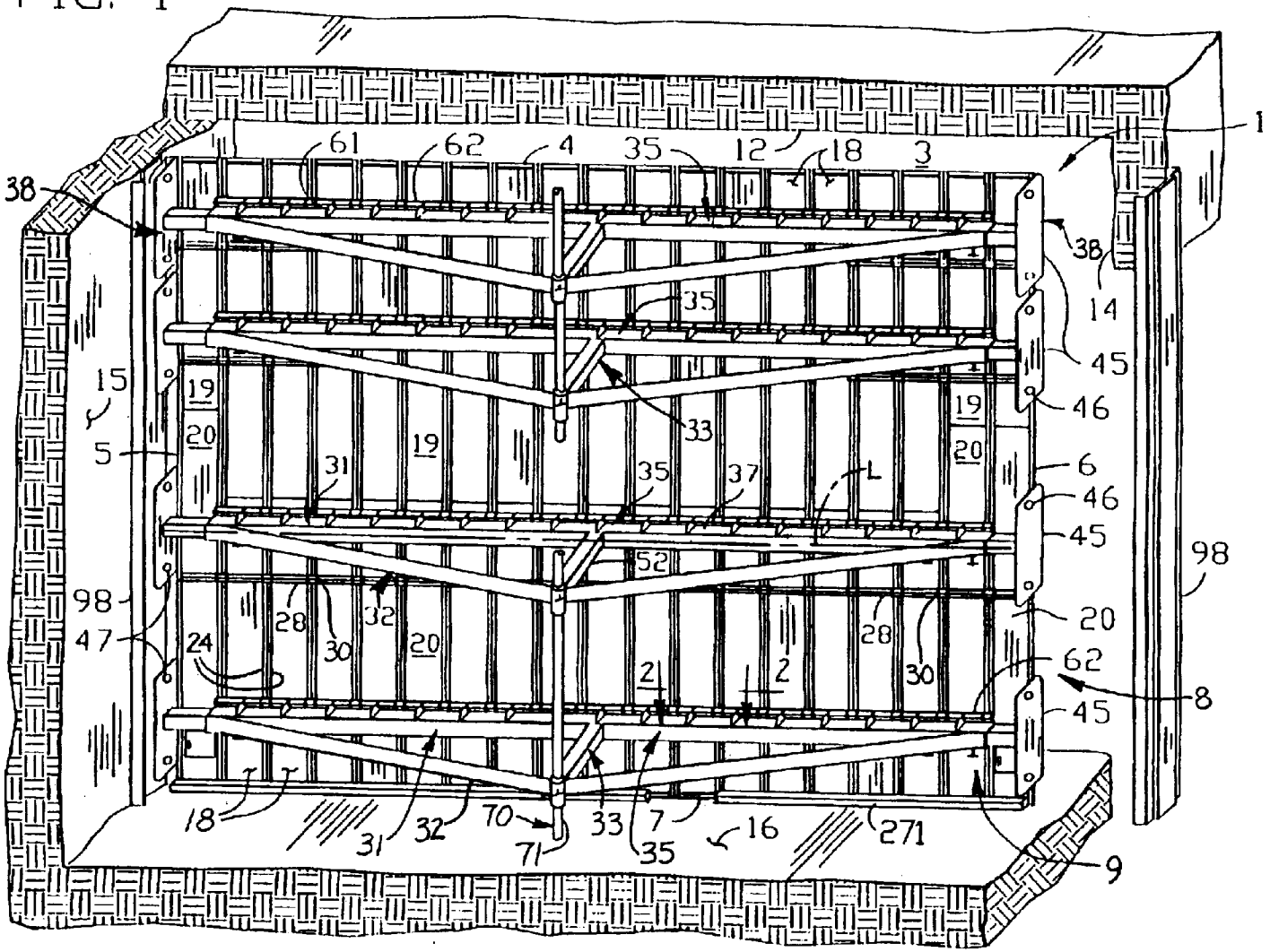
FIG. 1 is a fragmentary perspective view of a mine stopping in a mine with the stopping having a plurality of reinforcing braces secured thereto.

Referring to FIG. 1, the numeral 1 generally designates a high pressure stopping system of an embodiment of this invention adapted for use in mines to at least partially close a mine passageway 3. The system can be used to substantially or partially seal the passageway against air flow therethrough. In this embodiment, the stopping system 1 is used to substantially seal against air flow creating a pressure differential across the stopping system 1 with a normally high pressure side 8 and a normally low pressure side 9. This pressure differential applies force to the stopping system 1 in the direction of the higher pressure side 8 toward the lower pressure side 9. It is to be understood that the high pressure side 8 and the low pressure side 9 may switch under certain circumstances, but they are normally in one orientation. Also, the stopping may be incorrectly installed such that the high and low pressure sides 8, 9 are reversed. Sealing can be accomplished by having the top edge 4, side edges 5, 6 and bottom edge 7 of the stopping system adjacent to the roof 12, opposite side walls 14, 15 and the floor 16, respectively, and having suitable sealing material (e.g., polymeric foam such as polyurethane and polystyrene) therebetween.

Figure 2:
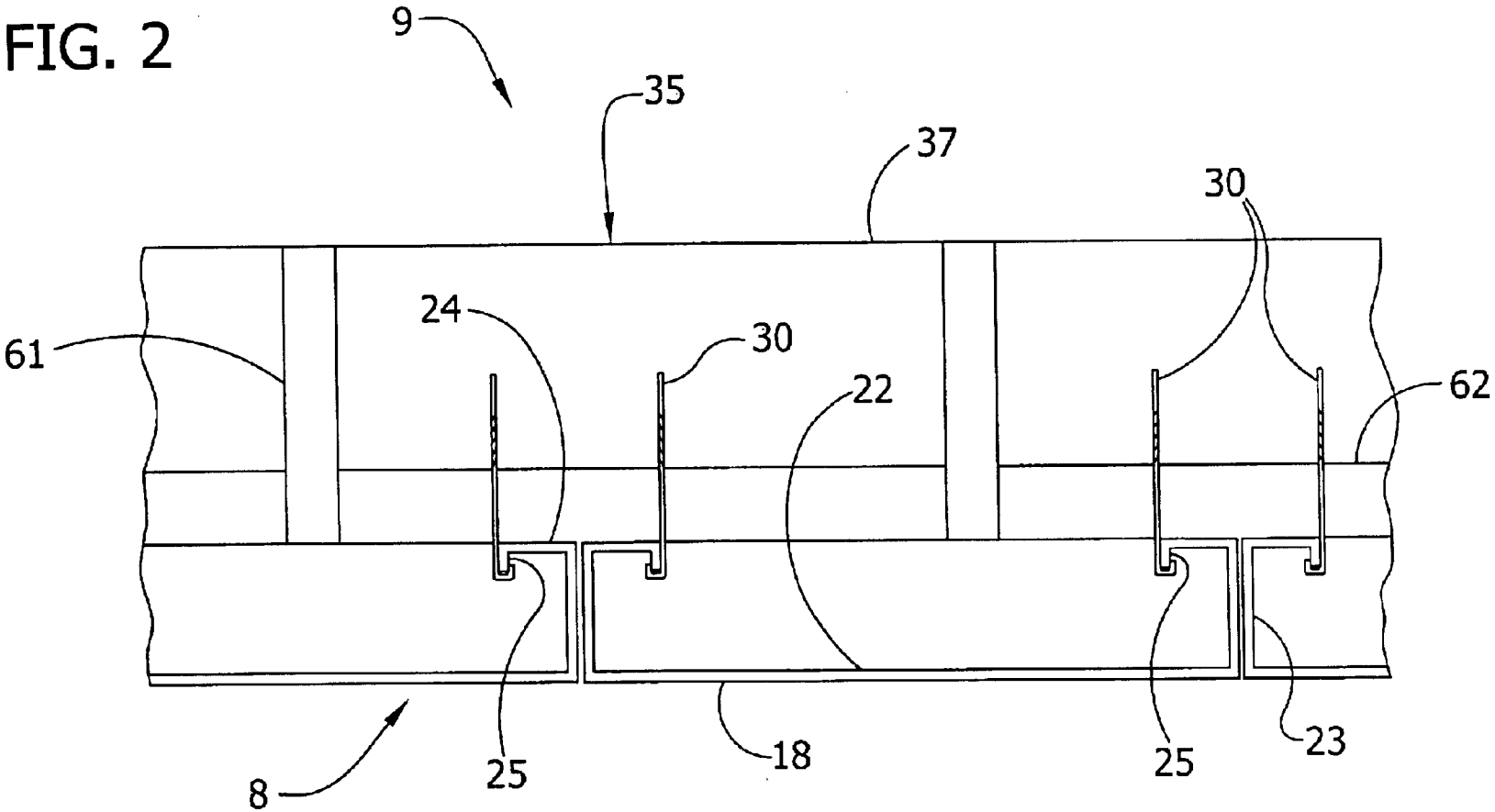
FIG. 2 is an enlarged fragmentary section view taken along the line 2—2 of FIG. 1

The stopping system 1 of this embodiment includes a plurality of stopping panels 18 positioned in side-by-side relation and extending vertically in the mine passageway 3 generally between the side walls 14, 15 to thereby form a stopping wall. The stopping panels 18 can be of any suitable style, e.g., each one can be fabricated as a single piece panel or multiple panels such as a pair of panel sections 19 (upper section) and 20 (lower section) which are preferably channel shaped (FIG. 2) in transverse cross section. The panel sections 19 and 20 are slidably or telescopically connected, i.e., one fits within the other and can move coaxially relative to one another to form a telescoping stopping panel 18 as exemplified in U.S. Pat. Nos. 4,483,642, 4,547,094, 4,820,081 and 4,911,577, which are incorporated herein by reference. As shown in FIG. 2, each panel section 19, 20 has a channel-shaped transverse cross section with a panel web 22, opposing flanges 23, inturned legs 24 extending parallel to the web and lips 25 extending parallel to the opposing flanges. The panel sections 19 and 20 are preferably of the same shape with one being slightly smaller than the other so the smaller one will fit within the larger one for connection and telescoping movement. Preferably, the panels 18 are metal, preferably steel.

When the panels 18 are installed in a mine, they are positioned in side-by-side relation and the upper section 19 is extended relative to the lower section 20 so that the panel extends from the floor 16 to the roof 12. Each panel is forced into engagement with the roof 12 and the lower tier panels by use of a jack (not shown), such as by the jacks shown in U.S. Pat. Nos. Re. 32,675 and 4,695,035, both of which are incorporated herein by reference. The panels 18 are suitably secured in position in the mine passageway 3 in side-by-side relation. Such securement can be by any suitable securement members and helps inhibit substantial relative movement between adjacent side-by side panels 18. As shown in FIG. 1, securement members in the form of angles 28 are placed against the legs 24 of the panels 19, 20 and are secured thereto as for example by twist wires 30 or any other suitable means. Alternatively, the angles may be positioned to extend between the side walls 14, 15 prior to placement of the panels, and the panels may be positioned in side-by-side relation in contact with the angles 18 and thereafter secured to the angles 28 by the twist wires. In such case, the angles 28 may be used to help align the panels across the passageway. Note that some or all of the angles 28 may be omitted if the stopping is constructed by installing a brace prior to installing the panels, as described below and in application Ser. No. 10/061,146. Others of the panels 18 are secured using angles attached to braces as described below. Note that the stopping panels may extend only partway across the passageway, e.g., other structures such as doors may be used to completely close the passageway.

Figure 3:
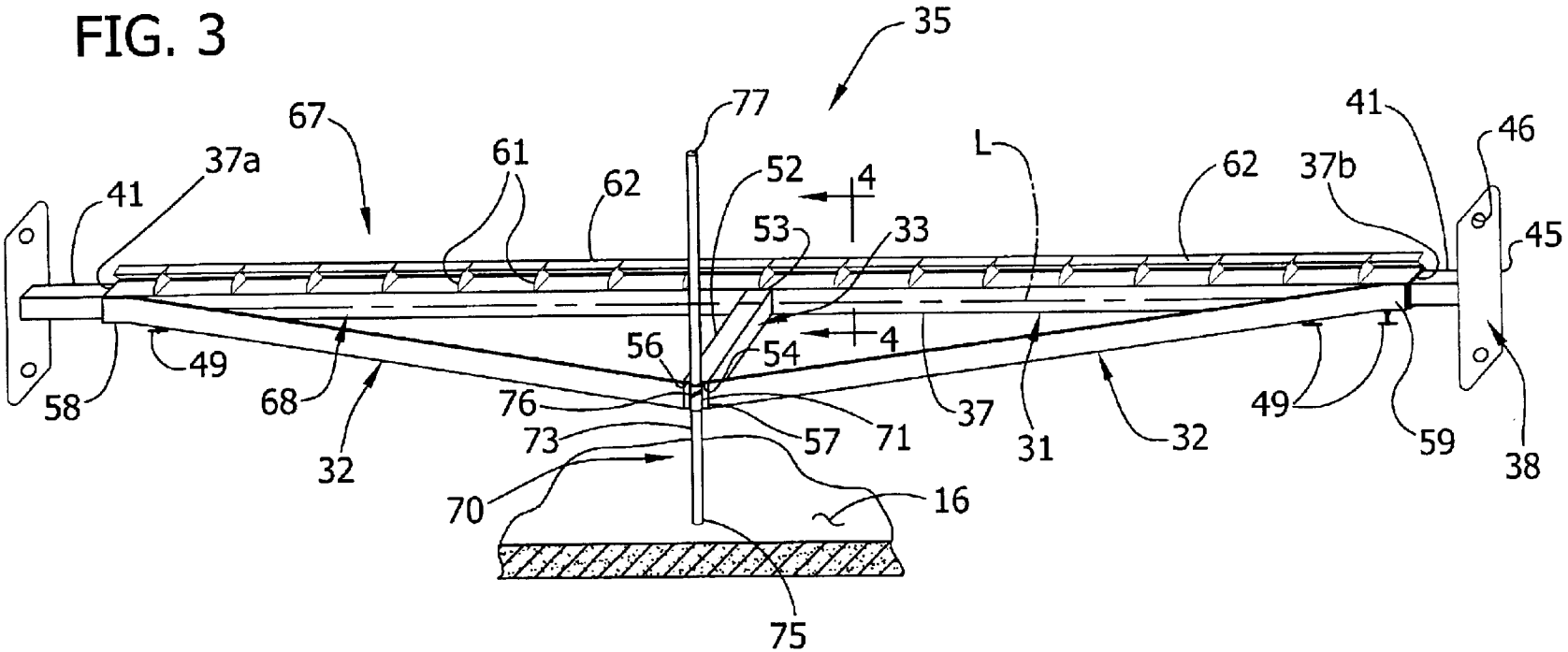
FIG. 3 is a perspective view of one brace of the system of FIG. 1.

Referring now to FIGS. 1 and 3, the stopping system 1 includes one or more horizontal reinforcing braces 35 which are preferably extensible or variable in length. In this embodiment, each brace 35 includes a chord (generally, elongate beam) generally designated 31, and structural members for reinforcing the chord. Here, the structural members include two struts generally designated 32 and a web generally designated 33 extending between the chord 31 and the struts. Alternatively, and as described below, the brace may include only the chord 31. The stopping system can utilize one or more braces secured thereto in a generally horizontal orientation. When more than one horizontal brace is used in a stopping system, the braces are spaced apart vertically (preferably spaced evenly) and are preferably generally parallel.

Each chord 31 has opposite first and second ends 31*a*, 31*b* and a longitudinal axis L. The chord 31 comprises at least one central support member or central beam 37. There may be more than one central beam 37 within the scope of this invention. Length adjustment or variation is provided by having at least one slide member 41 (generally, an extensible or telescoping portion) mounted on the central beam 37 for telescoping movement relative to the central beam. In this exemplary embodiment, the central beam 37 is tubular having a rectangular transverse cross section with inside dimensions (See FIG. 4). The slide member 41 has a corresponding rectangular transverse cross section with outside dimensions slightly smaller than the inside dimensions of the central beam 37 and is slidably received therein for telescoping movement. The central beam 37 may be sized smaller in cross section than the slide members 41 so that the central beam is received in ends of the slide members. It is to be understood that the cross sectional shape of the central beam 37 can vary, e.g., it may have an I-beam shape, as shown and described below with respect to FIG. 6. The shape of the slide member 41 preferably corresponds to the central beam 37, but may differ therefrom within the scope of this invention. Preferably a slide member 41 is mounted in each of two opposite ends 37*a*, 37*b* of the central beam 37 permitting length adjustment or variation of the chord 31 at both ends of the central beam 37. The illustrated embodiment shows the use of two slide members 41 in a central beam 37; however, only one slide member may be used within the scope of this invention. The length of the slide members 41 should be such that they will accommodate the maximum amount of mine wall divergence without disengaging from the central beam 37. During cycles of mine wall convergence and divergence, the central beam 37 could work completely to one side of the mine passageway. Thus, the slide member 41 on the opposite end (37*a* or 37*b*) of the central beam 37 is preferably long enough to prevent disengagement from the central beam. Additionally, sufficient lengths of the slide members 41 are preferably disposed in the central beam 37 to provide the necessary strength for the brace 35 to support the anticipated loads on the brace.

The brace 35 preferably includes anchor means 38 at opposite ends 31*a*, 31*b* of the chord 31 for mounting or securing the brace 35 to the mine wall. The anchor means 38 is operable to retain the brace 35 in position relative to the side walls 14, 15 when the walls converge and diverge causing load to be applied to the stopping 1. The anchor means 38 is affixed to the exteriorly positioned free ends 31*a*, 31*b* of the chord in a manner that will allow tension and compression to be applied to the slide members 41 from the side walls 14, 15. The anchor means 38 is preferably operable to allow for or effect both expansion and contraction of the length of the brace 35 and maintain the brace secured to the mine walls. The anchor means 38 is secured to a mine wall to prevent movement of the brace 35 relative to or along the mine passageway 3. In one embodiment, the anchor means 38 includes a plate 45 connected or secured to the exteriorly positioned free end of each of the slide members 41. The plate 45 lies in a plane that is generally perpendicular to the longitudinal axis L of the central beam 37 and that of the respective slide member 41. As shown in FIGS. 1 and 3, the plate 45 has a bearing surface area significantly greater than a cross-sectional area of the slide member 41 and of the central beam 37. The plate 45 typically has a bearing surface area between about 0.25 and 2.5 square feet and such area is about 2 to 25 times greater than that of the slide member 41 and central beam 37. The bearing surface area of the anchor means 38 in contact with the wall is preferably at least about 16 square inches, more preferably at least about 40 square inches, and even more preferably at least about 300 square inches. The plate 45 may have apertures 46 for receiving appropriate fasteners (not shown), such as anchor bolts, conventional roof bolts, or threaded studs. The fasteners are inserted into the apertures 46 and into holes in the side walls 14, 15. If threaded studs are used, the plate 45 is hung on the studs, and nuts are threaded onto respective studs to retain and secure the plate. Rather than separable fasteners, the plate may include a claw or teeth (not shown) for extending into the side walls 14, 15. Other forms of anchor means 38 could be used, and the anchor means may be omitted, e.g., if the cross-sectional area of the beam is sufficient to support the wall. If the plate 45 is omitted, the exteriorly positioned end of the slide member 41 or of the brace 35 (if the slide member is omitted) may be secured directly to the walls 14, 15 by fasteners, or may be inserted into holes made in the walls. Fasteners used to secure the anchor means 38 can also include brackets, clamps, claws or the like that are secured to the brace 35 and the mine walls 14, 15. Further, the plate 45 could have a separable clevis type mount. It is contemplated that the fasteners be made integral with the brace 35, e.g., by making the fasteners integral with the plate 45.

Retaining means is also provided to restrict telescoping movement of the slide members 41 in the central beam 37. As shown, the retaining means preferably comprises friction lock means including, in one embodiment, T-handled set screws 49 that are threadably mounted in the central support member 37. When the set screws 49 are tightened, they engage respective slide members 41 and frictionally retain the slide members in their initial adjusted position or a subsequent position due to wall movement. The friction between the set screws 49 and the slide members 41 resists relative telescoping of the central beam 37 and slide members so that the chord 31 is configured to have substantial columnar strength for bearing a substantial longitudinal load (i.e., axial or eccentric loading relative to the longitudinal axis L) applied to the chord. Thus, the brace 35 is sufficiently unyielding so as to provide substantial support to the side walls 14, 15. Substantial convergence or divergence of the side walls 14, 15 overcomes the frictional force causing telescoping movement of the slide members 41 relative to the central beam 37, as described more fully in application Ser. No. 10/061,146. The slide member 41 is locked relative to the central beam 37 such that the slide member will resist a substantial longitudinal load without yielding or sliding relative to the central beam.

The brace 35 in the embodiment of FIG. 3 is in the form of a king post truss. As shown in FIG. 3, the web 33 includes a king post 52, having opposite ends 53 and 54. The king post 52 is mounted generally centrally of the central beam 37. It has one end 53 adjacent to and suitably secured to the central beam 37 adjacent the center thereof such as by welding. The king post 52, as shown, is tubular and has a generally rectangular transverse cross section, though other shapes and non-tubular materials are contemplated. The other end 54 is positioned a distance from the central beam 37. The king post 52 of this embodiment is generally perpendicular to the central beam 37. The struts 32 have respective first ends 58, 59 and second ends 56, 57. The first ends 58, 59 are secured to opposite ends of the central beam 37, as by welding. The second ends 56, 57 are secured to the end 54 of the king post 52, as by welding.

The braces 35 are secured to the stopping panels 18 on the normally low pressure side 9 of the stopping system 1 to reduce bending or deformation of the stopping system. Such mounting and loading places the struts 32 in tension. The generally V-shape of the brace 35 results in a smaller quantity of material being needed to provide the required strength. Also, the general V-shape of the brace 35 results in the brace having a higher or larger moment of inertia at the center of the brace than at its opposite ends. Further, in the V-shape form of brace 35, the moment of inertia continuously increases from adjacent each end of the brace toward the central area of the brace 35 where it is at a maximum.

The struts 32 can be made from a flat metal strap and, when the brace 35 is in use, normal loading thereof will put the struts 32 in tension allowing for the use of a simple transverse cross section. Note that if other than normal loading is expected, e.g., loading which may subject the struts 32 to compression, the struts should be made of a different material such as rectangular tubing. When the brace 35 is loaded due to the pressure differential across the stopping 1, the loading force is directed from a front side 67 of the central beam 37 toward the respective ends 54, 56, 57 placing the strut 32 in tension and the king post 52 in compression. If the pressure differential is reversed so that the force is directed from the opposite side 68 of the central beam 37, the strut 32 resists compression loading.

Figure 4:
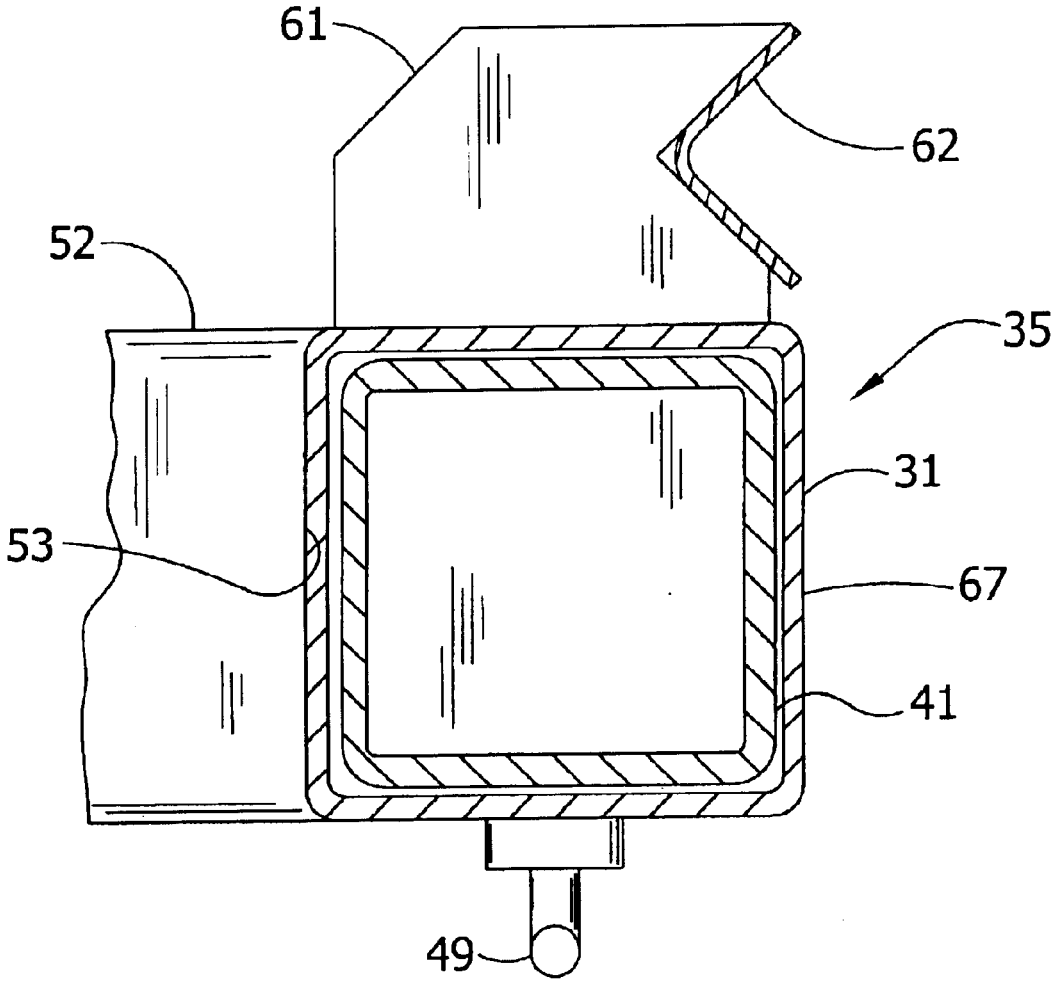
FIG. 4 an enlarged fragmentary section view taken along the line 4—4 of FIG. 3.

Referring to FIGS. 2–4, the brace 35 is provided with suitable securement means affixed to the central beam 37 for attaching or securing the brace to the stopping panels 18. In this embodiment, the securement means includes a plurality of uprights 61 (formed from metal plate, for example) suitably secured to the central beam 37 and spaced apart along the length thereof. An elongate panel securement member such as angle 62, is suitably secured to the uprights 61 with the open side of the angle facing away from the brace 35 and toward the stopping panels 18. The angle 62 is preferably made of metal, e.g., steel. Twist wires, clamps or other suitable means 30 can be used to secure the angle 62 and hence the brace 35 to the stopping panels 18.

Referring to FIGS. 1 and 3, the brace 35 may include a support generally designated 70 for supporting the brace. In this embodiment, the support comprises a leg 73 received through a tubular sleeve 71 attached to the second ends 56, 57 of the struts 32. The leg 73 of this embodiment is a circular metal tube having a foot end 75 adapted to engage the floor 16 and an opposite end 77 slidably receivable through the sleeve 71. As shown in FIG. 1, the leg 73 may extend through sleeves 71 of two or more braces 35. The leg 73 is suitably locked in position relative to the sleeve 71 by a set screw 76. During installation, the brace 35 is supported in a generally horizontal position (as by a forklift, cribbing or other suitable means) while the leg 73 is slid relative to the sleeve 71 so that the foot end 75 of the leg engages the floor 16 and so that the brace 35 remains generally horizontal after installation upon tightening of the set screw 76.

Figure 5:
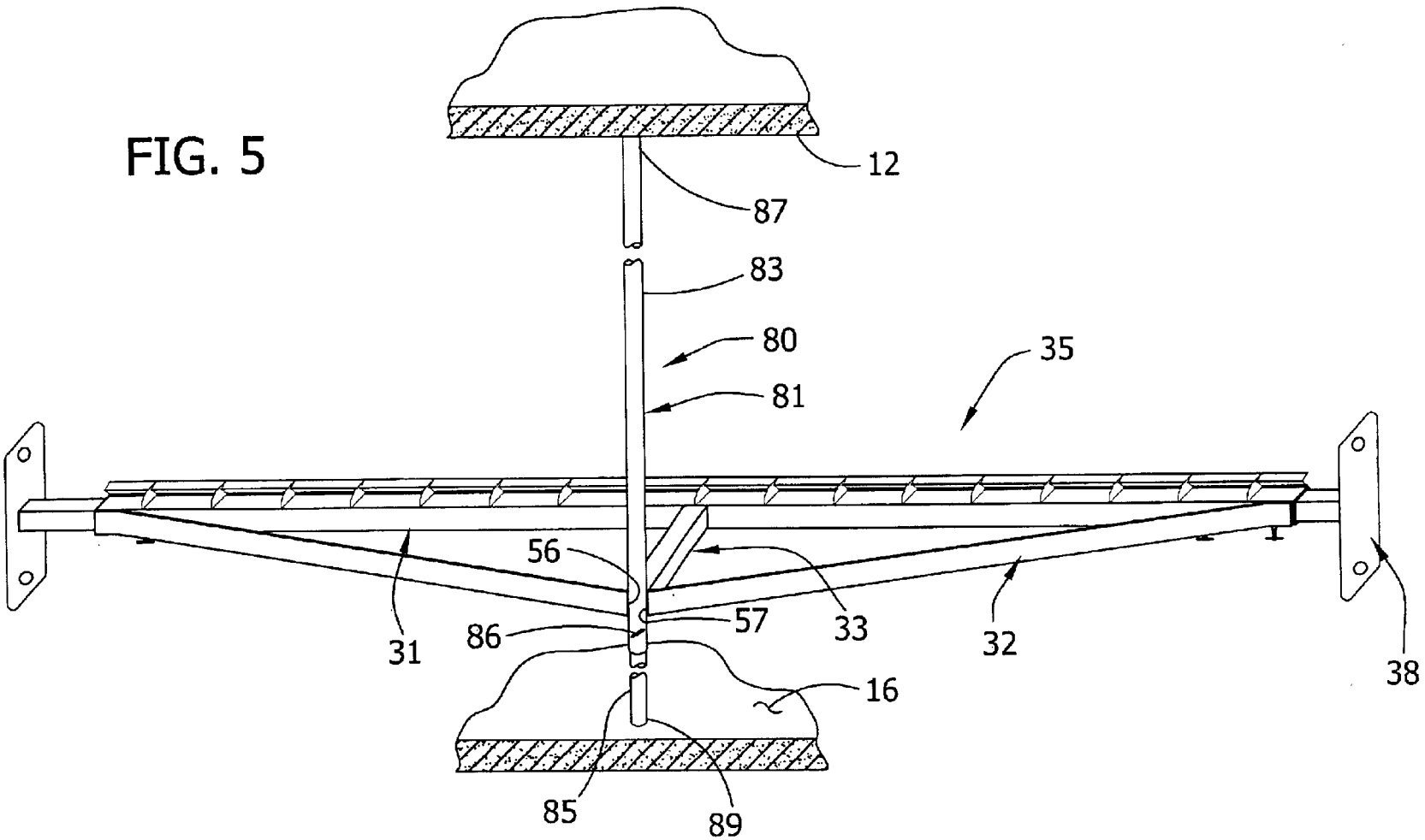
FIG. 5 is a perspective view of the brace of FIG. 3 but having a modified support.

In another embodiment shown in FIG. 5, a support 80 comprises a column 81 extending between the floor 16 and the roof 12 of the mine passageway 3. The column 81 includes a tubular upper member 83 attached (as by welding) to the second ends 56, 57 of the struts 32 and a lower member 85 slidably received in the upper member such that the lower member is extensible relative to the upper member. The lower member 85 is suitably locked in position relative to the upper member 83 by a set screw 86. During installation, the brace 35 is supported in a generally horizontal position such that a top end 87 of the upper member 83 engages the roof 12. The lower member 85 is extended relative to the upper member 83 and secured by a set screw 86 so that a foot end 89 of the lower member 85 engages the floor 16 and so that the brace 35 remains generally horizontal after installation. The set screw 86 functions substantially similar to the friction lock means described above to allow the lower member 85 to telescope into the upper member 83 in case of convergence of the roof 12 and the floor 16. Because the floor 16 is more likely to move than the roof 12, the lower member 85 is made to telescope into the upper member 83 as shown in this embodiment. Note that the column 81 may include an additional member extensible from the upper member 83 at its upper end 87. The top end 87 may also be secured to the roof 12, as by a fastener (not shown) or other suitable means. In such case, the lower member 85 may be omitted.

Though the supports 70, 80 are shown attached generally at the junction of the struts 32 and the web 33, the support may be attached anywhere along the struts or the web. The brace 35 may also include more than one support and/or more than one type of support. As described below, support 80 may also reduce the bending moment on the brace as described below.

Figure 6:
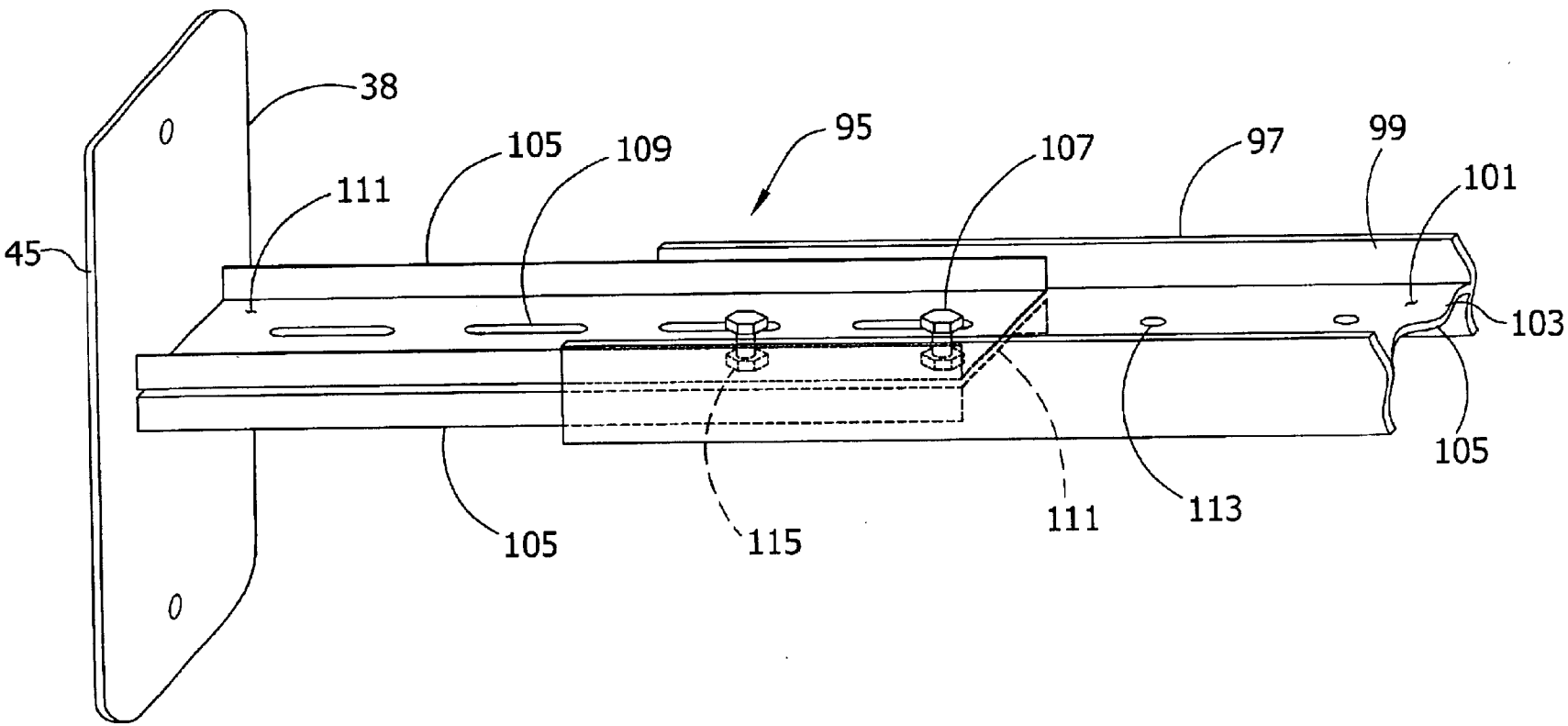
FIG. 6 is an enlarged fragmentary perspective view of a portion of another embodiment of the brace.

An alternative brace 95 is shown in FIG. 6, the stopping being omitted for clarity. The brace 95 comprises an I-beam shaped central beam 97 having flanges 99 and a web 101 which define an upper channel and a lower channel, and complementary-shaped slide members 105 above and below the central beam. In this embodiment, the slide members 105 are channel-shaped and sized to be received in respective upper and lower channels of the central beam 97 for mating engagement with the beam. Anchor means 38, e.g., plates 45, may be attached (as by welding) to outward ends of the slide members 105. When the slide members 105 are extended relative to the central beam 97 so that the plates 45 engage the side walls 14, 15 of the passageway 3, the plates are suitably secured to the side walls as described above. The slide members 105 are preferably secured relative to the central beam 97 by retaining means, such as by the friction lock means described above. In this embodiment, the friction lock means include bolts 107 received through elongate slots 109 in a web 111 of each slide member 105 and through one of several holes 113 in the web 105 of the central beam 97. The bolts 107 are suitably secured with nuts 115, and the nuts are tightened so as to allow the slide members 105 to slide relative to the central beam 97 under a longitudinal or columnar load, as described above with respect to the set screws 49. Note that the slide members 105 may slide a distance no greater than the length of the slots 109 in this embodiment and accordingly, the slots preferably have a length sufficient to accommodate the expected maximum convergence or divergence of the side walls 14, 15. The slide members 105 are formed of channel iron (e.g., hot-rolled channel iron) or formed sheet metal or plate. In this embodiment, the structural members (e.g., web 33 and struts 32) are omitted, though the brace 95 may include the web and struts or other types of reinforcing frames or trusses.

Referring to FIGS. 7–8 and 9A–9D, a modified brace generally designated 135 extends between opposite side walls and is secured thereto as described above. The brace 135 is generally the same as the brace 35 except that it does not include a web or strut (alternatively, the brace may include a web, strut or other reinforcing frame, truss or structural member) and includes two securement members which are shown as upper and lower sets of uprights 61 and angles 62. The upper and lower angles 62 and sets of uprights 61 are positioned on opposite sides of the central beam 37 with the angles 62 spaced apart in positions above and below the central beam 37. In this embodiment, the brace 135 can be used at a joint 137 between a lower tier 139 and an upper tier 140 of stopping panels 18 to secure them in end-to-end abutting relation allowing the use of shorter stopping panels 18. For example, two ten (10) foot tiers of stopping panels 18 can be used instead of one twenty (20) foot tier of stopping panels 18. Each panel of the lower tier 139 includes extensible upper and lower panel members 19, 20, a lower end 20*a* of the lower panel member being positioned adjacent the floor 16 of the passageway 3 and an upper end 19*b* of the upper panel member being spaced from the roof 12 of the passageway. Each panel 18 of the upper tier 140 includes extensible upper and lower panel members 19, 20, an upper end 19*b* of each upper panel member being positioned adjacent the roof of the passageway and a lower end 20*a* of each lower panel member abutting the upper end of a respective upper panel member of the panels of the lower tier 139 at the joint 137.

Referring to FIGS. 9A–9D, couplings or connectors, generally designated 151, may be mounted on the slide members 41 to provide support for extensible members or extensible angles 153 that extend from the angles 62. The connectors of this embodiment comprise slidable plates 155, each slidable plate including a generally rectangular opening 157 for receiving the slide member 41 and two (upper and lower) chevron-shaped openings 159 for receiving the extensible angles 153. The slidable plates 155 are thus adapted to slidably engage the slide member 41 and the extensible angles 153. The plates 155 are preferably positioned during installation so that there is at least one plate 155 adjacent each panel 18, thus supporting the extensible angle 153 at reasonable intervals along its length that extends past the end of the central beam 37. The panels 18 of the stopping are preferably secured to the extensible angles 153 by twist wires 30 so that the outermost panels of the stopping are connected to the brace and thereby to further reinforce the stopping. Note that an outward end 161 of each extensible angle 153 may be welded to the anchor means 38 (plate 45).

Figure 8:
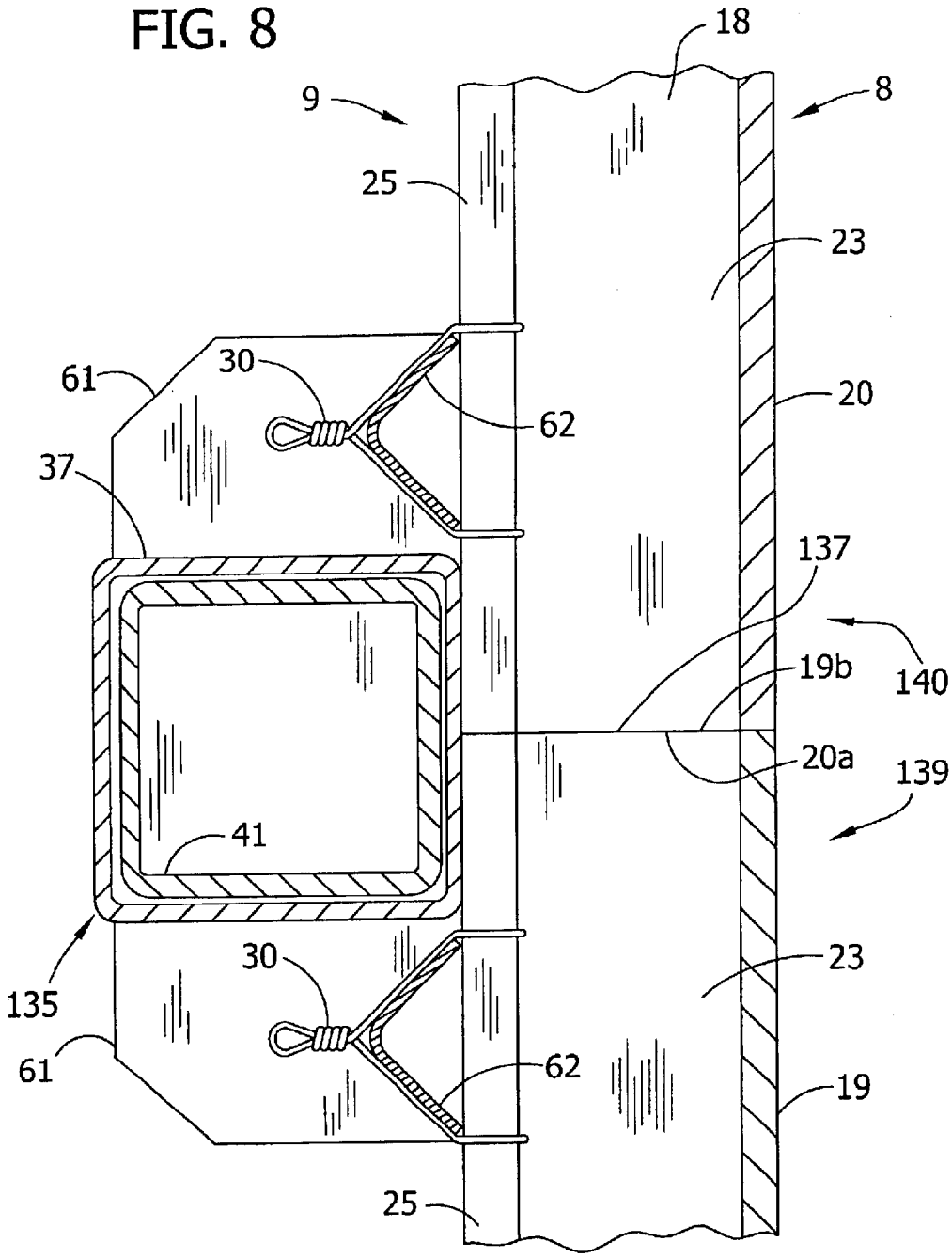
FIG. 8 an enlarged fragmentary section view taken along the line 8—8 of FIG. 7 showing another embodiment of the brace.
Figure 9A:
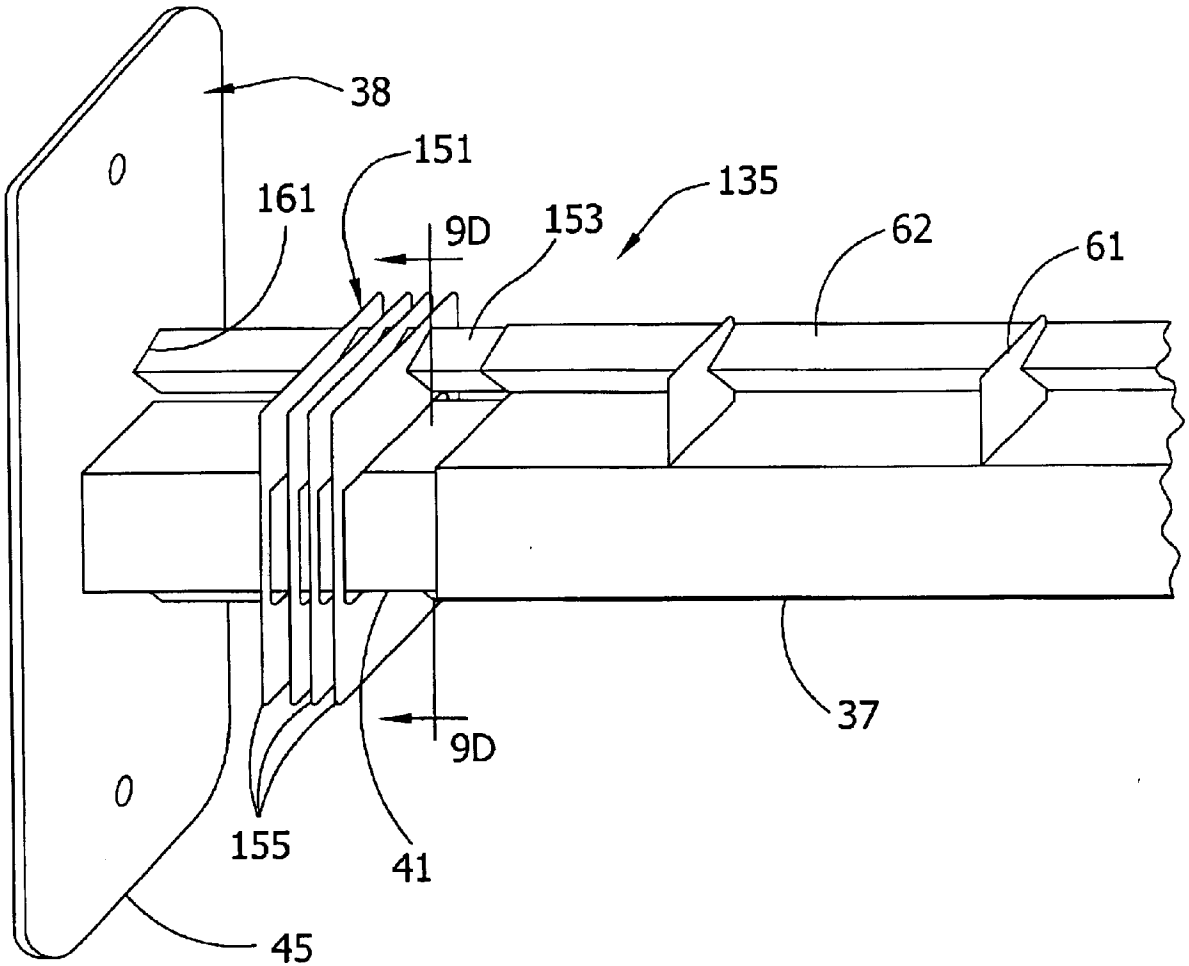
FIGS. 9A–9C are a progression of perspective views of an end of the brace of FIG. 7, FIG. 9D being an enlarged section view taken along the line 9D—9D of FIG. 9A.
Figure 9B:
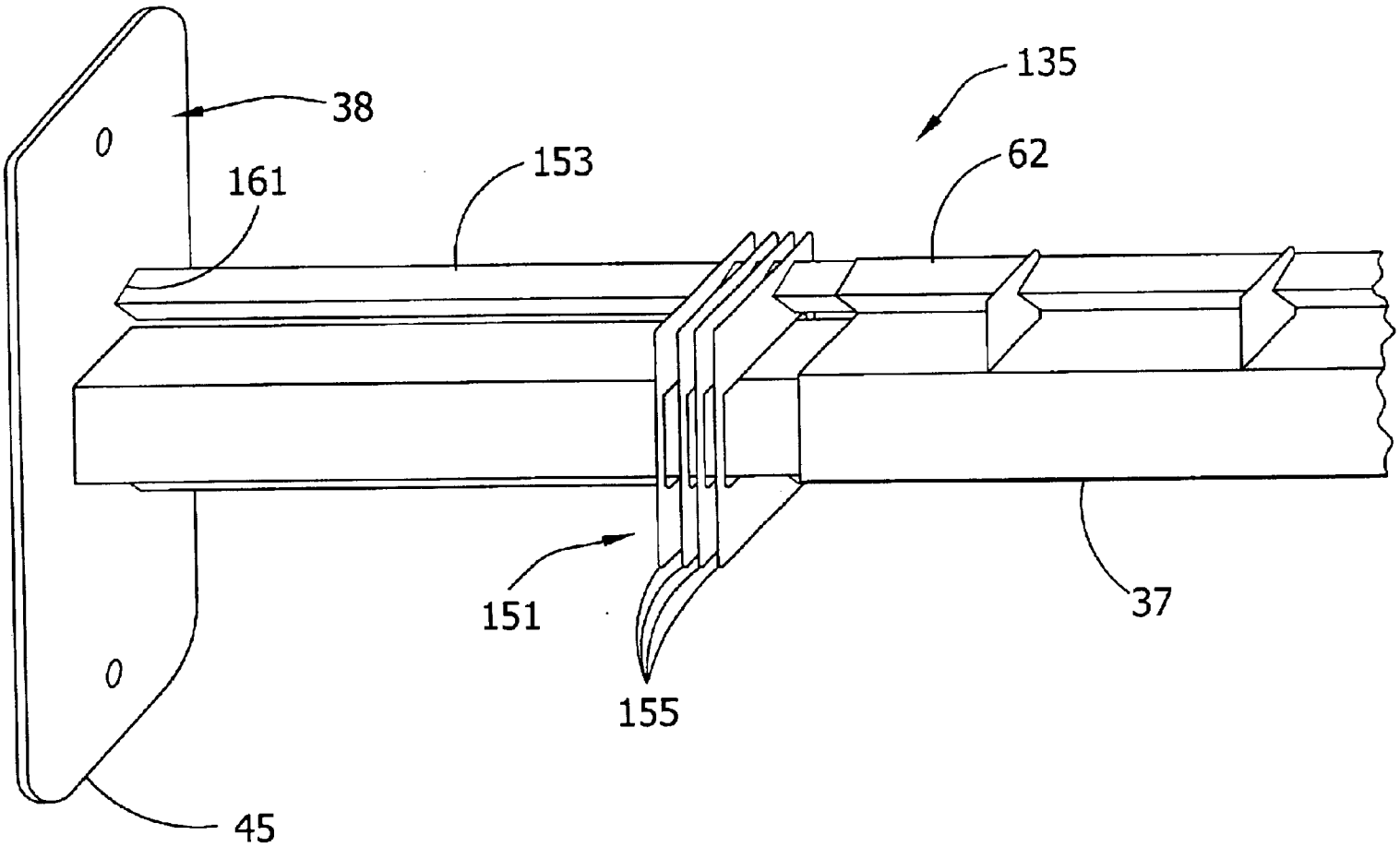
Figure 9C:
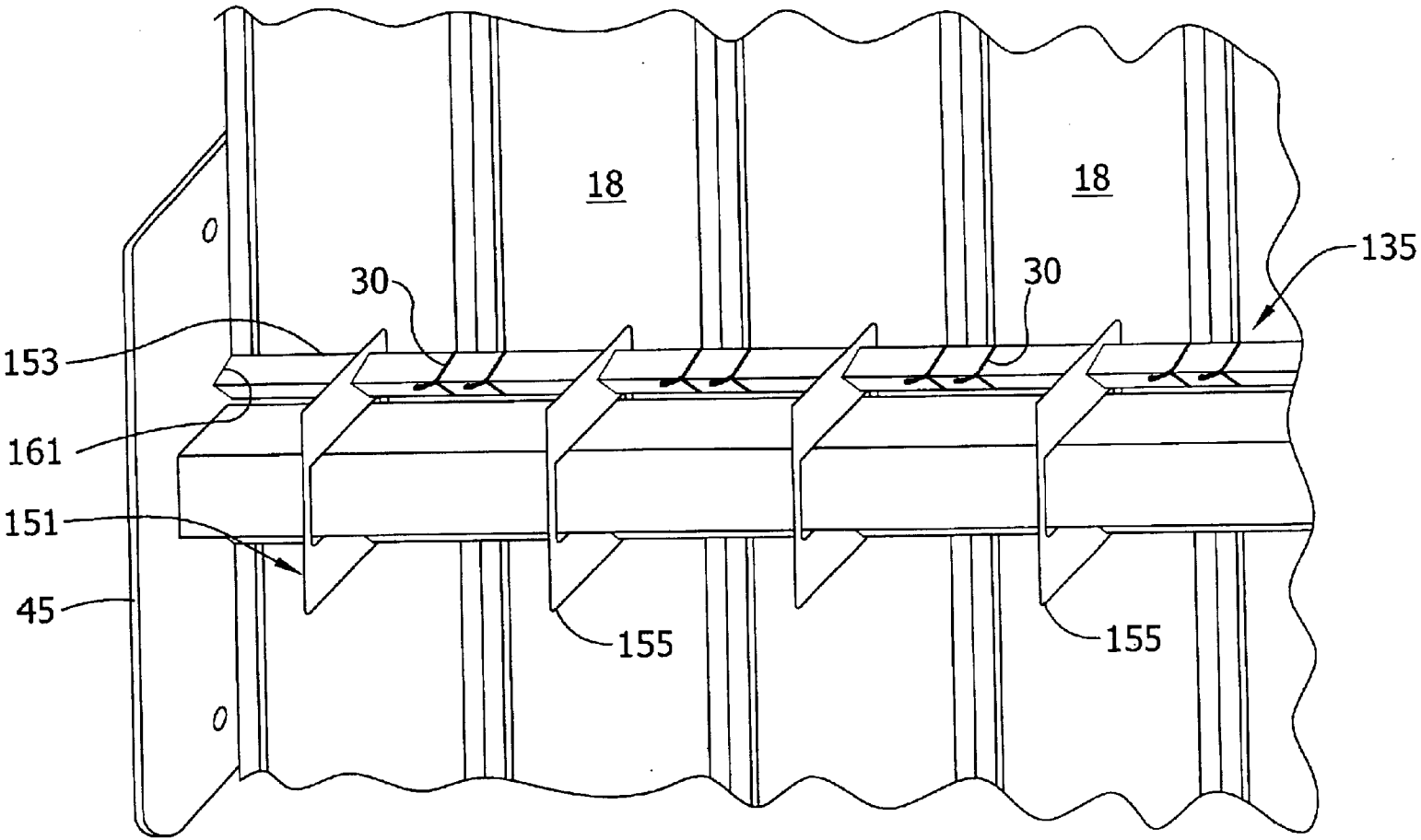
Figure 9D:
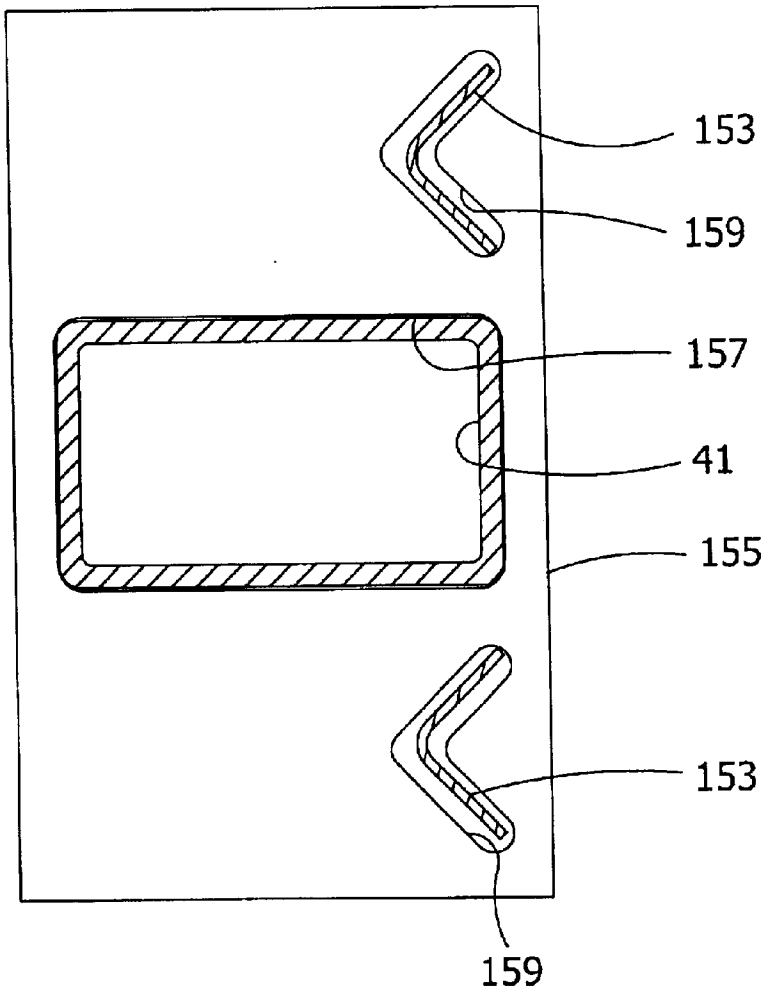

A method of installing a stopping according to the invention will be described with reference to FIGS. 7–8 and 9A–9D. The anchor plates 45 at the opposite ends of the brace 135 are secured to respective side walls 14, 15 using the anchor means described above so that the beam extends between the side walls. If the extensible angles are not welded to the anchor means, they are slid out from the slide members 61, 62 so that outward ends of the extensible members are adjacent the side walls 14, 15. The slidable plates are also spaced along the extensible angles as shown in FIG. 9C. The lower tier 139 of panels 18 is positioned so that a lower end 20*a* of each lower panel member 20 is adjacent to or engages the floor 16, and the upper panel member 19 is extended or telescoped from the lower panel member 20 so that the upper end is adjacent to or engages the lower angle 62 (or its extensible angle) of the brace 135. The upper panel members 19 are secured to the angle by twist wires 30 (FIG. 8), either before or after the jacking operation described below. The upper tier 140 of panels is positioned so that a lower end 20*a* of each lower panel member 20 engages at least one of the upper ends 19*b* of the panels of the lower tier 139. Preferably, panels 18 of the upper tier 140 are not aligned exactly atop the panels of the lower tier 139. In other words, the upper tier is offset laterally from the lower tier so that the ends of the upper or lower panels may "bite" into adjacent panels at the joint 137. Also, the lower panel members 20 of the upper tier 140 are positioned adjacent to or in engagement with the upper angle 62 of the brace 135. The upper panel member 19 of each panel 18 of the upper tier 140 is extended so that its upper end 19*b* is adjacent to or engages the roof 12 of the passageway 3. Note that the ends of the panels need not engage the floor 16 or the roof 12, e.g., when an anchor beam (described below) is used.

In a preferred method, each panel 18 of the upper tier 140 is forced into engagement with the roof 12 and the panels of the lower tier 139 by use of a jack (not shown), such as the jacks shown in U.S. Pat. Nos. Re. 32,675 and U.S. Pat. No. 4,695,035, both of which are incorporated herein by reference. In this embodiment, the head of the jack engages the head or upper end 19*b* of one of the upper panel members of the upper tier 140 and a base of the jack engages the foot or lower end 20*a* of the lower panel member 20 of the same panel 18. The jack is then actuated so that the lower end 20*a* of the panel member "bites" into the upper end 19*b*of at least one adjacent panel 18 of the lower tier 139. This jacking operation will also simultaneously force the lower end 20*a* of an adjacent panel 18 of the lower tier 139 into the floor 16. Optionally, prior to jacking the panels 18 of the upper tier 140, the jack may be extended from floor 16 to roof 12 so that the head of the jack is positioned to engage the upper end 19*b* of one of the panels 18 of the upper tier 140 and the base of the jack is positioned to engage the lower end 20*a* of an adjacent panel 18 of the lower tier 139 directly beneath the upper tier panel. The jack is then actuated to force the upper and lower ends 19*b*, 20*a* into engagement with the roof 12 and the floor 16, respectively. Also, the jack may further be used to jack the upper end 19*b* of one of the panels 18 of the lower tier 139 into the lower end 20*a* of an adjacent panel 18 of the upper tier 140 directly above the lower tier panel. After the jacking operation is completed, the lower ends 20*a* of the panels 18 of the upper tier 140 are secured to the upper angle 62 of the brace 135 by twist wires 30. As shown in FIG. 8, the joint 137 between the two tiers of stopping panels 18 is preferably located between the upper and lower angles 62. The brace 135 inhibits buckling of the upper and lower tiers 140, 139, and inhibits lateral movement of the lower tier panels relative to the upper tier panels, e.g., during the jacking operation. If desired, one or more braces of the type described herein can be used along with the brace 135 on a stopping system 1 for additional reinforcement. Note that more than two tiers 139, 140 of panels may be provided in a stopping of this invention.

Figure 10:
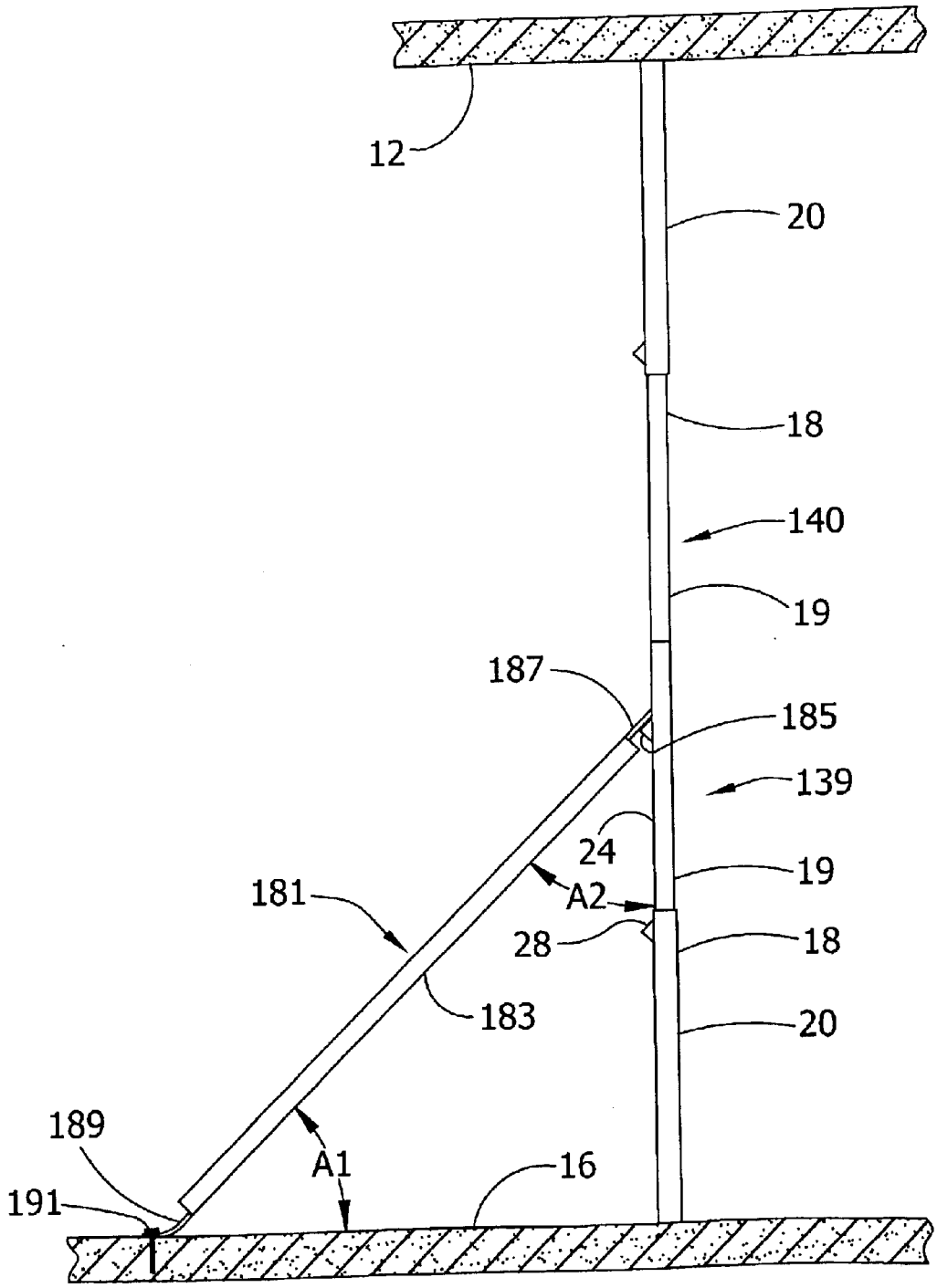
FIG. 10 is a fragmentary right side elevation of a floor-to-panel brace for use with a stopping system.

In an embodiment shown in FIG. 10, a plurality of floor-to-panel braces 181 extend from the floor 16 of the passageway 3 to the panels 18 of the lower tier 139. Each brace 181 is constructed of a first bar 183 which extends generally at acute angles A1, A2 relative to the floor 16 and to the panels 18, respectively, and a second bar 185 which extends transverse to the first bar and across the panels 18 (in engagement with legs 24 thereof) for securing the brace to the panels. The first and second bars 183, 185, which may be angle bars, for example, are connected by a metal strap 187 welded to both bars, and the second bar is suitably secured to the panels 18 by twist wires (omitted for clarity in FIG. 10) as described above. A lower end of the first bar 183 is preferably secured to the floor 16 of the passageway 3. The lower end includes a bent metal strap 189 secured to the floor 16 by a fastener, e.g., an anchor bolt 191. During installation, the lower tier 139 may be erected, for example conventionally using an angle 28 which extends from side wall 14 to side wall 15. The floor-to-panel braces 181 are then secured to the panels 18 of the lower tier 139, as by twist wires (omitted from FIG. 10). Thereafter, the panels 18 of the upper tier 140 are erected on top of the panels of the lower tier 139 substantially as described above. The braces 181 inhibit lateral movement of the lower tier panels 139 relative to the upper tier panels 140, especially during installation of the upper tier. The braces 181 also inhibit buckling of the upper and lower tiers 140, 139. Other configurations of the braces are contemplated within the scope of this invention. For example, in combination with or instead of the floor-to-panel braces, similarly constructed roof-to panel braces (not shown) may extend from the roof of the passageway to the upper tier panels. Also, such braces may be used with a single tier stopping, such as the stopping system 1 of FIG. 1.

Figure 11:
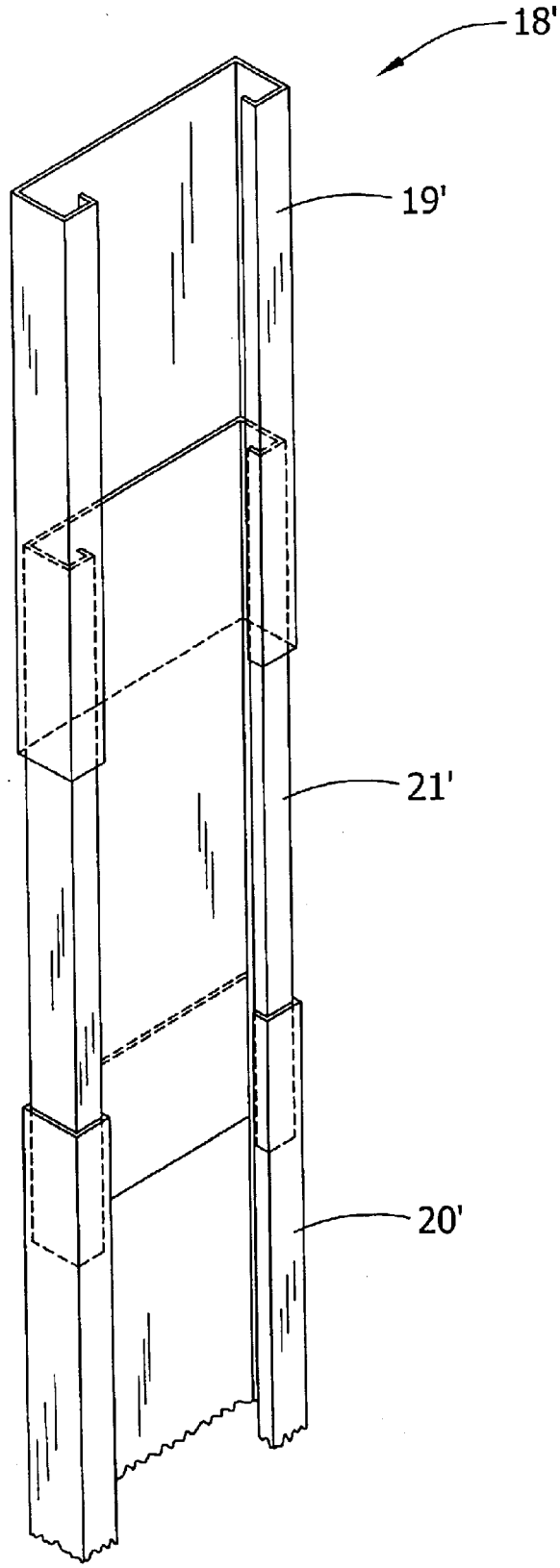
FIGS. 11 and 12 are fragmentary perspective views of other panels usable in the stopping system.
Figure 11A:
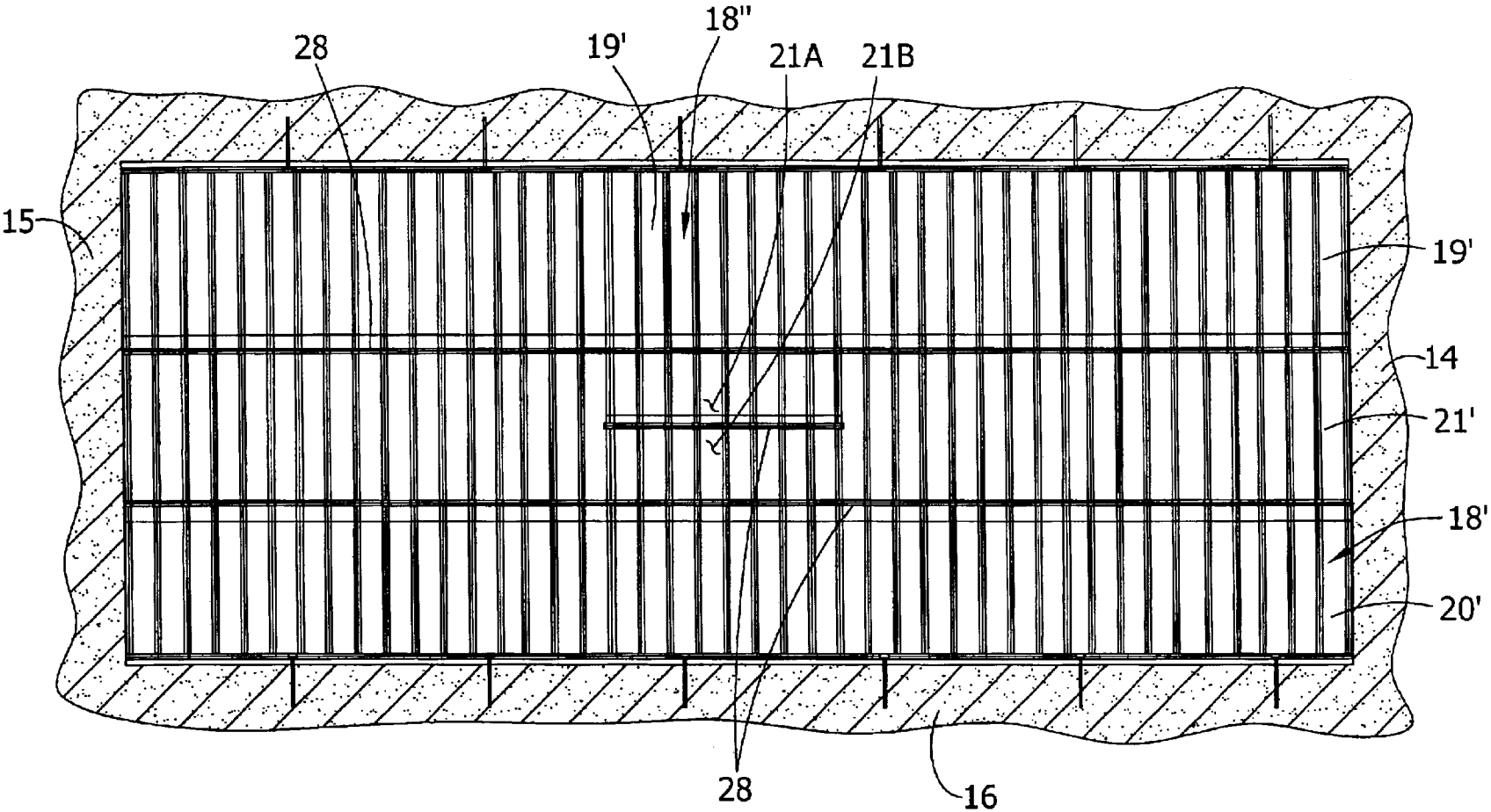
FIG. 11A is a front elevation of a stopping incorporating the panels.

Referring to FIGS. 11 and 11A, a modified stopping panel 18' usable in place of panels 18 and in any stopping of this invention includes an elongate lower panel member 20', an elongate upper panel member 19' and an elongate intermediate panel member 21' disposed between the lower and upper panel members. As used in the stoppings shown herein, a lower end of the lower panel member 20' will be placed adjacent to or in engagement with the floor 16 and an upper end of the upper panel member 19' will be adjacent to or in engagement with the roof 12. The intermediate panel member 21' is a one-piece panel member as shown in FIG. 11, but may include any number of panel segments (see FIG. 12). In this embodiment, the intermediate panel member 21' is a conventional Kennedy metal panel member sized for a telescoping fit with the upper and lower panel members 20', 19' such that the lower end of the intermediate panel member is in engagement with the lower panel member and an upper end of the intermediate panel member is in engagement with the upper panel member. As positioned in the stopping, the intermediate panel member 21' is suitably secured to the upper and lower panel members 20', 19' using an elongate member such as the braces described herein or the angles 28.

Figure 12:
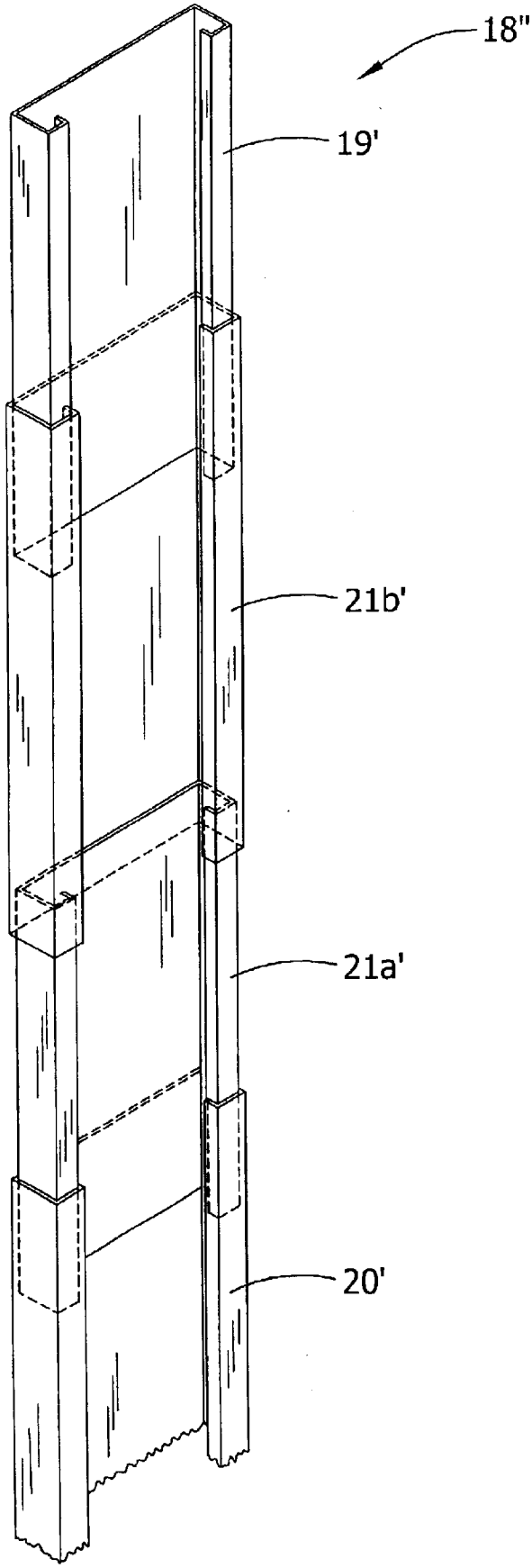

In the panel 18" of FIG. 12, the intermediate panel member comprises two panel segments 21*a*', 21*b*'. The intermediate panel segments may be fixed relative to one another, as by welding or fasteners, or may be secured by an angle 28 and twist wires.

The panels 18', 18" are advantageously used in any of the stoppings shown herein and in any combination with each other or other types of panels. The panels 18', 18" may also be used in a stopping which does not have the braces shown herein. For example in FIG. 11A, a simplified stopping may be constructed using angles 28 to secure the intermediate panel member 21' or segments 21*a*', 21*b* of each panel with the lower and upper members 20', 19' in a conventional manner, such as that shown in U.S. Pat. No. 4,483,642 (e.g., using twist wires). Preferably, the panels 18' and 18" are installed to allow yielding in the event of convergence, i.e., to allow the intermediate panel member to telescope into the upper member and/or lower member of the panel.

Figure 7:
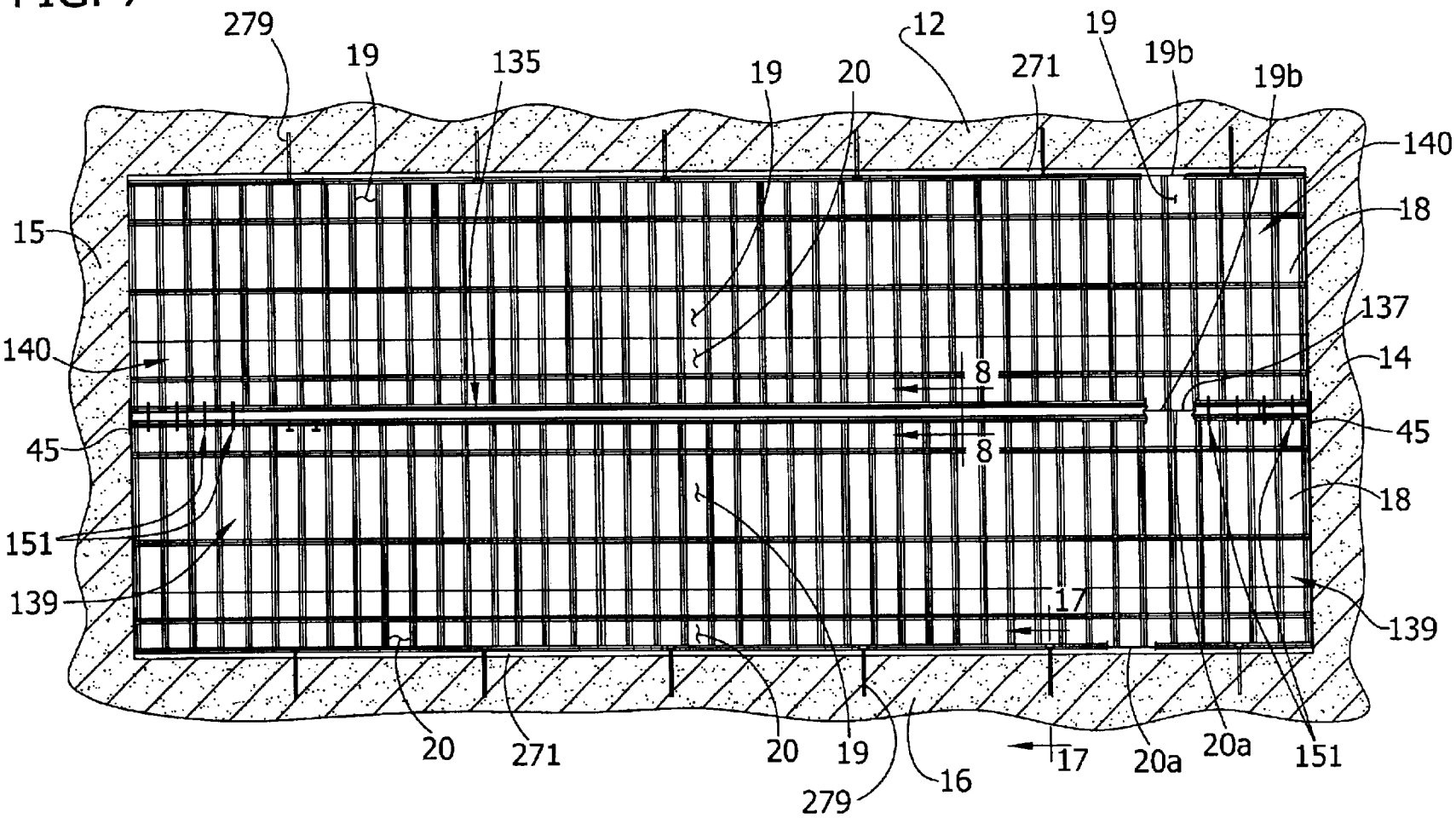
FIG. 7 is a front elevation of a two-tier stopping system.
Figure 13:
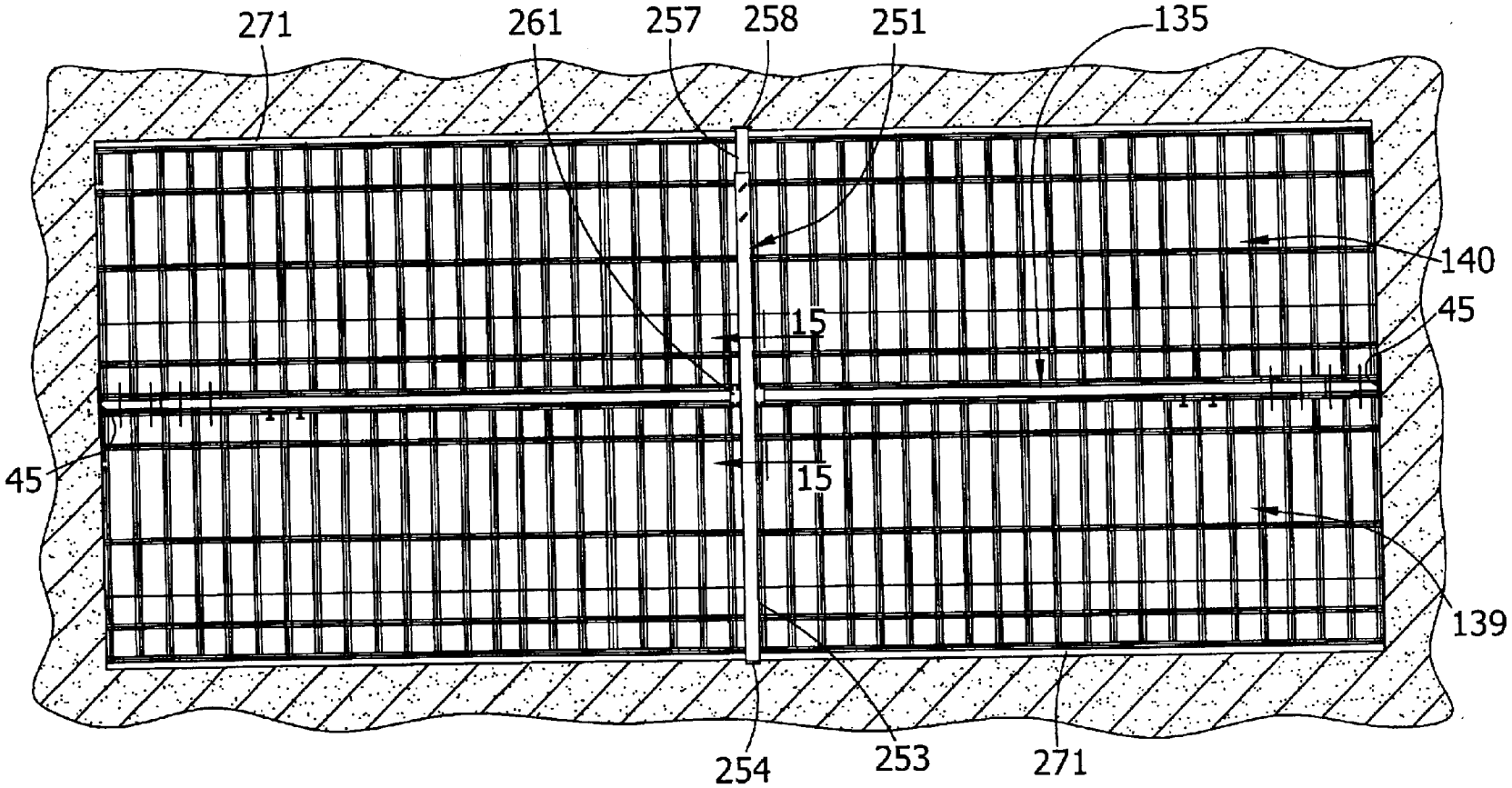
FIG. 13 is a front elevation of a two-tier stopping similar to that of FIG. 7 but including a vertical support.
Figure 14:
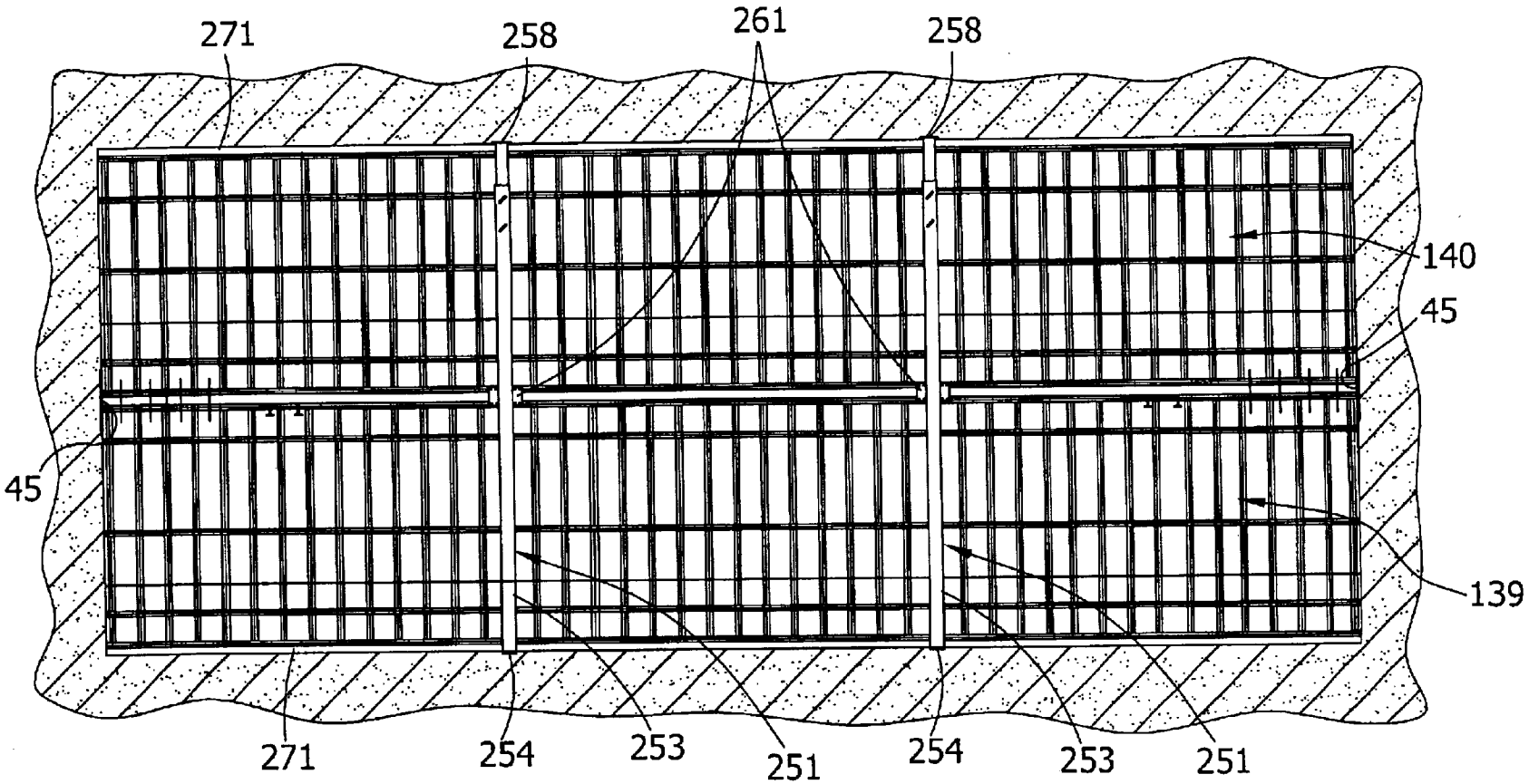
FIG. 14 is a front elevation of a stopping similar to that of FIG. 13 but including two vertical supports.

FIGS. 13–14 show stoppings substantially similar to the stopping of FIG. 7 except that the bending moment on the brace 135 caused by the air pressure against the stopping is substantially reduced by at least one floor-to-roof vertical column. (See Bending Moment Examples discussed below.) The stopping of FIG. 13 includes a generally vertical column 251 extending from the floor 16 to the roof 12 and attached to the brace 135 for reinforcing the brace against the bending moment. The column 251 includes a lower column member 253 having a lower end 254 engaging the floor 16 and an extensible upper column member 257 adapted to be extensible relative to the lower column member (e.g., the upper member telescopes relative to lower column member, as shown) so that its upper end 258 engages the roof. Thus, the height of the column 251 is adaptable to fit the height of the passageway. The extensible column member is yieldably secured by set screws relative to the lower column member so that the extensible column member may telescope relative to the lower column member in case of convergence, and so that the column members do not inelastically yield or fail. Alternatively, the lower member 253 may extend from or telescope from the upper member 257, e.g., the column 251 as shown may be turned upside down, within the scope of this invention. Also, the column 251 may be forced or jacked into engagement with the floor 16 and the roof 12 and secured by suitable means to the roof and the floor. The vertical column members 251 are preferably made of tubing of suitable (e.g., rectangular) cross-section.

Figure 16:
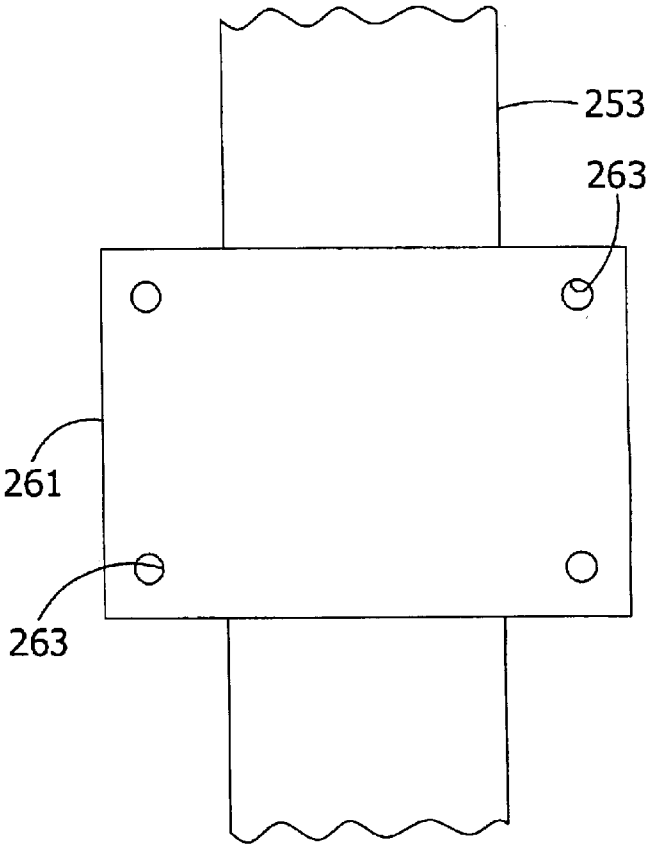
FIG. 16 is a section view taken along line 16—16 of FIG. 15.
Figure 15:
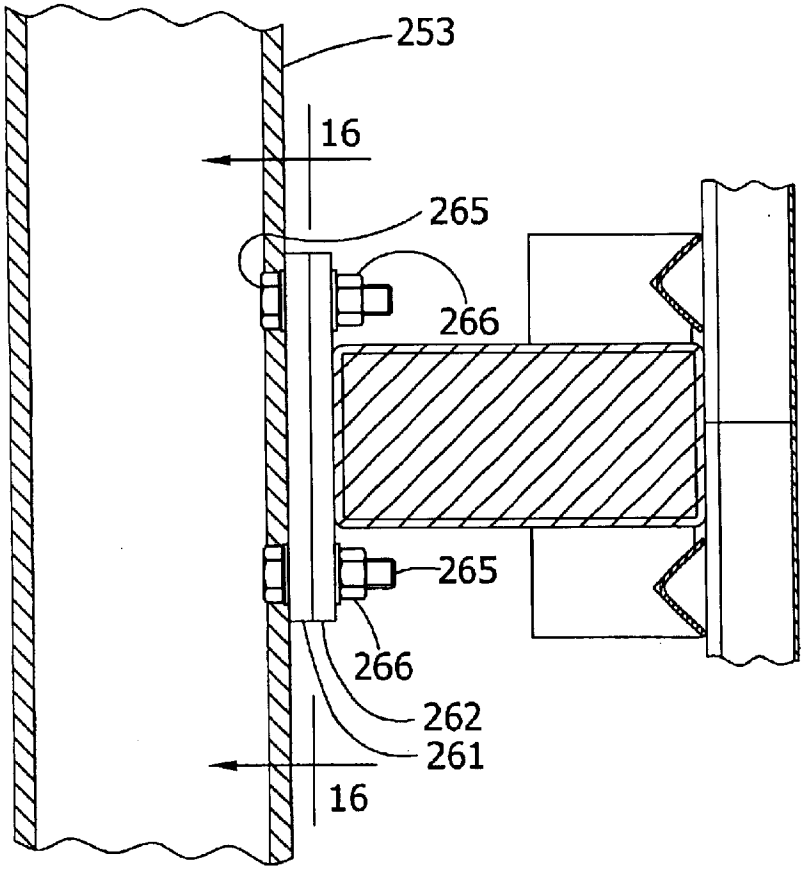
FIG. 15 is a section view taken along line 15—15 of FIG. 13.

Vertical column 251 may be fastened or connected to the brace 135, as shown for example in FIGS. 15–16. Opposing vertical plates 261, 262 are affixed (e.g., welded) to the vertical column 251 and to the brace 135, respectively. The plate 261 includes holes 263 alignable with holes in the opposing plate 262 so that fastener bolts 265 secured by nuts 266 can be inserted in the holes to connect the brace and column. Other fastening or connection means are contemplated. The column 251 is preferably attached to the brace 135, but it is contemplated that the column not be attached but merely be placed sufficiently close to the brace so that the brace engages the column, at least when the brace is under load.

The bending moment force on the brace 135 varies in magnitude along the length of the brace. If one vertical column 251 is used, the column is preferably disposed at a position along the length of the brace 135 where the bending moment magnitude is greatest. Typically, this position is approximately the center of the brace 135 (the point of extreme fiber stress, as described below, assuming the load is uniform across the stopping), but the position may vary, e.g., due to obstructions or turns in the passageway. As described below in the Bending Moment Examples, the air load capacity of the stopping may be effectively quadrupled by installation of one vertical column 251. Preferably, the column is constructed so that it will not inelastically yield under a bending moment caused by an air pressure differential of at least about 2 inches water gauge, more preferably at least about 5 inches water gauge, more preferably at least about 10 inches water gauge, and even more preferably at least about 20 inches water gauge. The differential may be caused by static (fan) pressure or dynamic pressure such as from blasting or ground or equipment movements. Additional generally vertical columns may be included, especially for extremely wide passages to further reduce the bending moment on the brace and increase the air load capacity of the stopping. For example, as shown in FIG. 14, two columns 251 substantially identical to the column just described are attached to the brace for reinforcing the brace. The columns are evenly spaced so that the brace is effectively divided into three spans. Even more columns may be added within the scope of this invention. Further, a brace (e.g., brace 35) may include any combination of columns 251 attached directly to the beam or columns 81 attached to the structural members (e.g., struts or ribs) within the scope of this invention.

The braces and columns of this invention have substantial bending strength for bearing a substantial transverse load applied to the beam generally transversely of the beam. Such load is typically applied by the air pressure differential acting against the mine stopping system and transferred to the brace and columns. Preferably, as an example where one brace and one column is used, the brace and column are sized for an exemplary sized stopping system having a width of 20 feet and a height of 15 feet so that the brace and column do not inelastically yield under a transverse load caused by a pressure differential of at least about 2 inches water gauge, more preferably at least about 5 inches water gauge, more preferably at least about 10 inches water gauge, and even more preferably at least about 20 inches water gauge. For another exemplary sized stopping system having a width of 40 feet and a height of 30 feet, the brace and column are sized so that it does not inelastically yield under a transverse load caused by a pressure differential of at least about 2 inches water gauge, more preferably at least about 5 inches water gauge, more preferably at least about 10 inches water gauge, and even more preferably at least about 20 inches water gauge. Note that the brace, the column, and each panel of the stopping will be stressed due to the air pressure differential and will deflect a distance due to the air pressure differential (the transverse load). Preferably, the respective stiffness of each brace, column and panel are selected so that each brace, column and panel are similarly stressed when the stopping system is placed under the transverse load. More specifically, the point of extreme fiber stress in, for example, the brace generally occurs midway across the passageway, and such extreme fiber stress is substantially similar to extreme fiber stress in the panels and column that are positioned midway across the passageway. The point of extreme fiber stress in the panels and column (at least for a single tier stopping) is likely to be adjacent the point of extreme fiber stress in the brace. In a two-tier stopping, the point of extreme fiber stress in each panel will likely be about midway up each tier; and if two braces are used, the point is likely about midway between the braces. Extreme fiber stress is local stress through a small area (a point or a line) furthest from the neutral axis or centroid on the brace or the panels, and is typically measured in pounds per square inch (psi). More specifically, for panels positioned generally midway across the passageway, extreme fiber stress in the panels is at least about 40 percent, more preferably about 60 percent, even more preferably about 80 percent, of the extreme fiber stress in the brace and the column when the transverse load is applied to the stopping so that the beam, the column and the panels are effective to resist the transverse load. In another example, if the brace has an extreme fiber stress of 10,000 psi due to the transverse load, then the extreme fiber stress in the adjacent panels is at least about 4000 psi, more preferably at least about 6000 psi, and even more preferably at least about 8000 psi. Also note that the brace, the column and the panels will deflect similar distances under similar loads. By stressing the brace, the column and the panels similarly, overstressing one or the other beyond their respective yield points is inhibited. Moreover, material used in the brace, column and panels is not wasted as would be the case if only one of the brace, column and panel was significantly stressed by the transverse load. For example, if the brace did not carry a significant portion of the transverse load, then the material therein would be wasted with respect to resisting the transverse load. Note that the stopping may be comprised of materials other than panels, e.g., masonry blocks.

Figure 17:
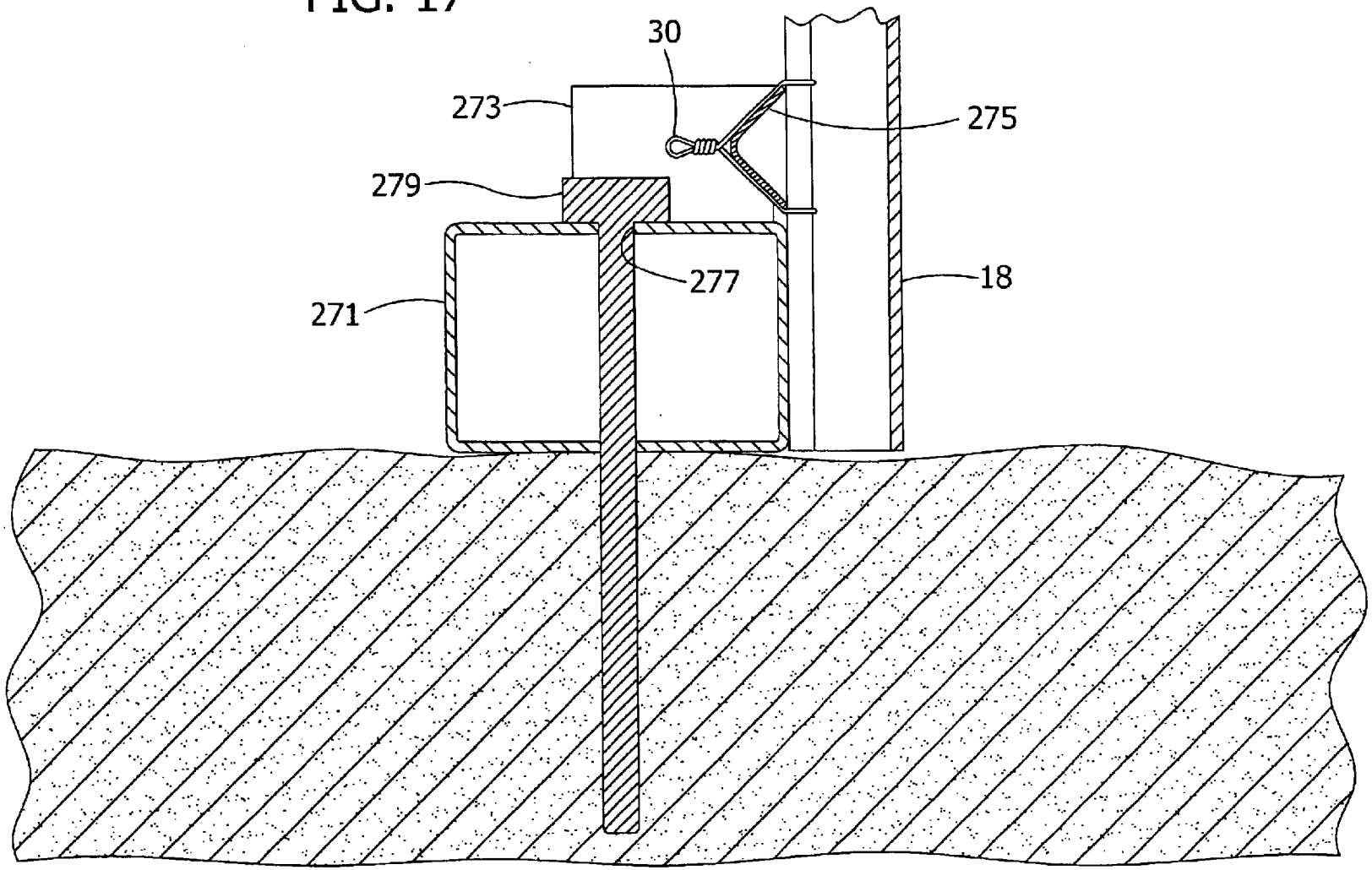
FIG. 17 is a section view taken along line 17—17 of FIG. 7.

Referring to FIGS. 1, 7, 13–14, and 17, a generally horizontal elongate anchor beam 271 is secured to the floor 16 of the passageway 3 and positioned adjacent to the lower ends of the panels for inhibiting movement of the panels under a transverse load, e.g., an air load, applied to the stopping. Similarly, a generally horizontal anchor beam 271 is secured to the roof 12 of the passageway 3 (omitted from FIG. 1) and positioned in engagement with the upper ends of the panels for inhibiting movement of the panels. As best shown in FIG. 17, each anchor beam 271 of this embodiment is a rectangular cross section tube having a plurality of holes 277 for receiving anchor bolts 279. (The anchor bolts are omitted from FIGS. 1, 7 and 13–14.) As shown in FIG. 17, the panels of the stopping are preferably secured to the anchor beam 271 using an arrangement similar to that of the braces described above. Each anchor beam 271 includes a plurality of uprights 273 secured to the anchor beam and spaced apart along the length thereof. Securement means such as an angle 275 is secured to the uprights 273 with the open side facing away from the anchor beam 271 and toward the stopping panels 18. Suitable means such as twist wires 30 are used to secure the angle 275 and hence the anchor beam 271 to the stopping panels 18. The anchor beams 271 are particularly advantageous as applied to multiple tier stoppings because such stoppings are likely to be greater in size and the pressure against the stopping is greater. Such conditions inhibit anchorage of the panels to the floor 16 and roof 12 and make the use of the anchor beam 271 more desirable. Specifically, panels in a multiple tier stopping are not as easily jacked into the floor 16 and roof 12 because the panels in each tier are not continuous from floor to roof. Note that lower and upper ends of the panels need not necessarily engage the floor and roof, respectively, when the anchor beams 271 are used. (See FIG. 17). The anchor beams 271 are also advantageous where there is no continuous member extending between the roof 16 and floor 12 (e.g., no vertical column, as shown in FIG. 11). Note that the anchor beams 271 may be made of material other than rectangular tubing, i.e., substantially any rigid elongate member may be used within the scope of this invention. Further, the anchor beams 271 may include several separable sections, or may include telescoping or extensible members similar to the braces described herein.

As shown in FIG. 1, a pair of vertical anchor channels 98 can be mounted on the side walls 14, 15, as with anchor bolts (not shown), and be positioned between the plates 45 and the respective side walls 14, 15 in any of the stopping systems disclosed herein. These channels provide smoother surfaces than the walls 14, 15 and thus a better side fit for the stopping panels 18. Sealing material can be used between the stopping system and the roof 12, side walls 14, 15 and the floor 16 of the mine passageway 3. Alternatively, the stopping system may include side extensions or "side pans", such as those shown in U.S. Pat. No. Re. 32,871, which is incorporated herein by reference.

In a preferred embodiment, the stopping systems are constructed of metal, e.g., steel.

The braces disclosed herein may be used to reinforce an existing stopping, i.e., a stopping where the stopping panels are already in position when the brace is installed. However, because the braces are much more readily sized to fit the passageway, installation of the reinforced stopping system is generally quicker and easier than the prior art method of erecting a stopping. The braces and the described methods of installation, may also be used in combination with a pre-assembled stopping or pre-assembled stopping sections, as shown in our co-assigned U.S. patent application Ser. No. 09/903,429 filed Jul. 11, 2001, which is incorporated herein by reference.

The embodiments of the invention disclosed above are illustrative. Many variations of the mine stoppings, braces and other structures are possible without departing from the scope of the invention. For example, suitable braces may or may not include reinforcing frames, trusses or structural members such as the struts 32 and web 33 described above. Such structural members for the brace may have shapes other than the general V-shape shown in FIG. 10. The cross sectional shapes of the components of the brace can also be different. For example, the strut 32 could be an angle member and the chord 31 and slide members 41 could be round.

Preferred braces of this invention will accommodate convergence and divergence of the mine and still be effective in supporting the stopping panels 18 against deflection from a pressure differential, and in supporting the mine walls 14, 15. The structure of the braces allows them to self adjust to accommodate mine convergence and divergence while continuously supporting the walls to inhibit cracking and sloughing off. Such support reduces maintenance and operation costs. By having variable length, the braces can be used in mine passages of various widths, thereby increasing the versatility of application and decreasing the number of different braces needed in inventory. The braces may further provide a simple means of joining together two tiers of stopping panels 18 stacked one on top of the other, while also providing resistance to deflection of the stopping system due to different pressures on opposite sides of the system.

Note that the slide members 41 need not telescope relative to the central beam 37. It is also contemplated that the braces of the various embodiments of this invention may be non-extensible, i.e., the slide members may be omitted and the brace sized to fit a passageway of a known width.

Bending Moment Examples

As described in these Examples, installation of a brace halfway up the panel's height effectively quadruples the air load capacity of the stopping. Similarly, installation of a vertical column halfway along the stopping length effectively quadruples the air load capacity of the stopping.

The bending moment formula (beam formula) for simply supported (i.e., supports are positioned at opposite ends of the beams) and uniformly loaded beams is $M=WL/8$, where the weight (W) on the beam (in pounds) times the length (L) of the beam (in inches) divided by 8 gives the bending moment (M, also referred to as torque) on the beam in inch pounds. A required section modulus of the beam is determined by the beam stress formula, $S=M/F_b$, where $F_b$ is extreme fiber stress in bending. $F_b$ is typically 21,600 psi for ordinary structural steel, which is 60% (for a 1.67 factor of safety) of the material's yield strength of 60,000 Psi. If the required section modulus is known, the beam size can be selected. Any beam having at least the required section modulus should support the load without being overstressed.

An example beam is 120 inches long and simply supports a uniform load of 330 pounds. The bending moment on the beam is: (120×330)/8=4950 inch pounds. The required section modulus is 4950/21600=0.2292 $in^3$. Any beam having a section modulus of at least 0.2292 $in^3$ is sufficient.

In the above example, the beam length is 120 inches. The square law states that if the length is doubled, the allowable load per foot on the beam in pounds per linear foot would be reduced by a factor of four. To test the square law in a second example, the 120 inch length of the first example is changed to 240 inches, and the load is halved from 330 pounds (33 pounds per foot) to 165 pounds (8.25 pounds per foot). According to the square law, the bending moment should be the same, i.e., 4950 inch pounds. Using the numbers of the second example, the square law is proven as follows: WL/8=(165×240)/8=4950 inch pounds.

Another way to prove the square law is to examine a given beam or stopping panel. In this third example, the beam is a standard 1 foot wide by 10 feet long stopping panel subjected to an air load. The above examples indicate that one could quadruple the air pressure on the panel (without causing failure) if one cut the panel's length in half. From the above examples, if the panel has a section modulus of 0.2292 $in^3$, then the panel is fully stressed (but not over stressed) under a uniform 330 pound air load. This air load on the panel would be caused by a typical mine ventilating air pressure of 6.346 inches water gauge. The panel should be similarly stressed, i.e., the panel should experience a similar 21,600 psi extreme fiber stress, if the length of the panel (beam) is reduced to 5 feet and air pressure is increased to 25.384 inches water gauge. The square law is tested in this example as follows: the total load on the panel is 25.384×5.2×5=660 pounds (the factor 5.2 converts inches water gauge to pounds per square foot) and the bending moment is WL/8=(660×60)/8=4950 inch pounds. Because the section modulus did not change, the stress should be the same, which is proved as follows: $F_b$=4950/0.2292=21600 psi. Therefore, if one cuts the height of a stopping panel in half (as by the installation of a brace or truss or the like halfway along the panel's length), the air load capacity of the stopping is quadrupled. Similarly, if one cuts the length of the stopping in half (as by installation of a vertical column halfway along the stopping length, as described above), the air load capacity of the stopping is quadrupled.

Although not as common as the beam formula above, another way of examining the problem is to consider the load or weight value in the formula as weight units per unit length, in this case pounds per inch. The formula would therefore include the square factor, i.e., $(W^2L)/8$ instead of the more familiar WL/8.

When introducing elements of the present invention or the preferred embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A mine stopping installed in a mine passageway having a floor, a roof and opposing walls comprising:

a plurality of elongate panels extending in side-by-side relation from adjacent the floor to adjacent the roof of the passageway to at least partially close the passageway;

the panels having longitudinal axes extending generally vertically;

an elongate brace extending generally horizontally between the side walls of the passageway adjacent to the panels; and a generally vertical column extending from the floor to the roof for reinforcing the brace.

2. A mine stopping as set forth in claim 1 wherein the brace is subject to a bending moment due to air pressure against the stopping, the column being positioned to reinforce the brace against the bending moment.

3. A mine stopping as set forth in claim 2 wherein the bending moment on the brace varies in magnitude along the length of the brace, and wherein the column is disposed at a position along the length of the brace where the bending moment magnitude is greatest.

4. A mine stopping as set forth in claim 2 wherein at least some of the panels are secured to the brace and wherein the brace is attached to the column.

5. A mine stopping as set forth in claim 1 wherein the column includes a lower column member and an extensible column member extensible relative to the lower column member so that a height of the column is adaptable to fit the passageway.

6. A mine stopping as set forth in claim 1 further comprising a second generally vertical column extending from the floor to the roof and attached to the brace for reinforcing the brace, the second column being spaced from the first-referenced column so that an effective span of the brace is reduced.

7. A mine stopping as set forth in claim 1 wherein the brace includes at least one structural member adapted to extend generally outwardly away from the stopping when the brace is installed adjacent the stopping, the column being secured to the structural member.

8. A mine stopping as set forth in claim 1 wherein each panel comprises first and second panel members adapted to telescope relative to one another.

9. A mine stopping installed in a mine passageway having a floor, a roof and opposing side walls comprising:

a stopping wall having a lower end adjacent the floor of the passageway;

the stopping wall including a plurality of elongate panels having longitudinal axes extending generally vertically; and a generally horizontal anchor beam secured to the floor of the passageway and positioned adjacent the lower end of the stopping wall for inhibiting movement of the stopping wall under a transverse load applied to the stopping.

10. A mine stopping as set forth in claim 9 wherein the stopping wall includes a plurality of panels positioned side-by-side across the passageway, lower ends of the panels defining the lower end of the stopping wall.

11. A mine stopping as set forth in claim 10 wherein at least some of the lower ends of the panels are secured to the anchor beam.

12. A mine stopping as set forth in claim 10 wherein the panels include upper panel members having upper ends adjacent the roof of the passageway, the stopping further comprising a generally horizontal anchor beam secured to the roof of the passageway and positioned adjacent the upper ends of the upper panel members for inhibiting movement of the panels.

13. A mine stopping as set forth in claim 12 wherein the panels include upper tier panels and lower tier panels, the upper tier panels including said upper panel members adjacent the roof and the lower tier panels including lower panel members adjacent the floor.

14. A mine stopping as set forth in claim 9 wherein each panel comprises first and second members adapted to telescope relative to one another.

15. A mine stopping installed in a mine passageway having a floor, a roof and opposing side walls comprising:

a stopping wall having an upper end adjacent the roof of the passageway;

the stopping wall including a plurality of elongate panels having longitudinal axes extended generally vertically; and a generally horizontal anchor beam secured to the roof of the passageway and positioned adjacent the upper end of the stopping wall for inhibiting movement of the stopping wall under a transverse load applied to the stopping.

16. A mine stopping as set forth in claim 15 wherein the stopping wall includes a plurality of panels positioned side-by-side across the passageway, upper ends of the panels defining the upper end of the stopping wall.

17. A mine stopping as set forth in claim 16 wherein the upper ends are secured to the anchor beam.

18. A mine stopping as set forth in claim 15 wherein each panel comprises first and second members adapted to telescope relative to one another.

19. A brace for reinforcing a mine stopping system against deflection when the system is under load, the stopping system being installed in a mine passageway having a floor, a roof and opposing side walls, the brace comprising:

a chord having opposite ends adapted to be secured to respective side walls of the passageway adjacent the stopping;

at least one structural member having at least one end secured to the chord and adapted to extend generally laterally away from the stopping such that a second end of the structural members is spaced laterally from the chord and the stopping when the brace is installed adjacent the stopping; and a support connected to the second end of the at least one structural member and having an end adapted to engage the floor or the roof of the mine passageway for supporting the brace.

20. A brace set forth in claim 19 wherein the support extends from the structural member to the floor of the mine passageway.

21. A brace set forth in claim 19 wherein the support extends from the structural member to the roof of the mine passageway.

22. A brace set forth in claim 19 wherein the support is a column extending between the floor and roof of the mine passageway.

23. A brace set forth in claim 19 wherein the support includes an upper member attached to the brace and a lower member extensible relative to the upper member.

24. A brace set forth in claim 19 wherein the chord includes a central beam having opposite ends, and the at least one structural member includes struts and a web, each strut having a first end secured to the central beam and a second end secured to the web, the web extending between the central beam and the struts and wherein the support is connected to at least one of the struts and the web.

25. A brace set forth in claim 24 wherein the support is positioned generally at a center of the brace.

26. A brace adapted to extend between opposite side walls of a mine passageway comprising:

a central beam; and at least one slide member connected to the central beam and adapted for extensible movement relative to the central beam whereby the brace has a variable length;

the central beam being I-beam shaped and the at least one slide member being channel shaped for mating engagement with the central beam.

27. A brace as set forth in claim 26 further comprising friction lock means for locking the slide member in position with respect to the central beam, the friction lock means being adapted to permit sliding of the slide member relative to the central beam in the event of movement of the side walls of the mine.

28. A brace as set forth in claim 26 wherein the slide member is disposed in an upper channel of the central beam, and further comprising a second channel shaped slide member disposed in a lower channel of the central beam.

29. A brace as set forth in claim 28 wherein the friction lock means includes a bolt extending through the slide members.

30. A brace as set forth in claim 26 in combination with a mine stopping extending across the passageway, the brace disposed adjacent the stopping for reinforcing the stopping.

31. A brace for reinforcing a stopping wall in a mine passageway comprising:

a central beam;

at least one slide member slidably connected to the central beam to provide relative movement therebetween whereby the brace has a variable length;

at least one securement member fixed to the central beam and adapted for connection to the stopping wall, the securement member including an extensible member slidably connected to the securement member to provide relative movement therebetween; and a coupling connecting the slide member and the extensible member.

32. A brace as set forth in claim 31 wherein the coupling is slidable relative to the slide member and the extensible member.

33. A brace as set forth in claim 32 wherein the coupling includes a plate having openings therein for receiving the slide member and the extensible member.

34. A brace as set forth in claim 32 wherein the coupling comprises a plate having a central opening sized for receiving the slide member and two openings disposed on opposite sides of the central opening shaped to receive the extensible members of two securement members disposed on opposite sides of the slide member.

35. A brace as set forth in claim 31 in combination with the stopping wall, the securement member and extensible member being connected to the stopping wall to further reinforce the stopping wall.

36. A mine stopping installed in a mine passageway having a floor, roof and opposing walls comprising:

a plurality of extensible, telescoping panels adapted to extended from the floor to the roof to at least partially close the passageway;

an elongate brace extending generally horizontally between the side walls of the passageway adjacent to the panels; and a generally vertically column extending from the floor to the roof for reinforcing the brace.

* * * * *

UNITED STATES PATENT AND TRADEMARK OFFICE

CERTIFICATE OF CORRECTION

PATENT NO. : 6,846,132 B2
DATED : January 25, 2005
INVENTOR(S) : William R. Kennedy et al.

It is certified that error appears in the above-identified patent and that said Letters Patent is hereby corrected as shown below:

Title page,
Item [*] Notice, insert
-- This patent is subject to a Terminal Disclaimer. --.

Column 17,
Lines 2 and 23, "second members" should read -- second panel members --.

Column 18,
Lines 54-55, "to extended from" should read -- to extend from --.
Line 60, "generally vertically column" should read -- generally vertical column --.

Signed and Sealed this

Twenty-fifth Day of April, 2006

JON W. DUDAS
*Director of the United States Patent and Trademark Office*